US009351583B2

(12) United States Patent
Baldassarra

(10) Patent No.: US 9,351,583 B2
(45) Date of Patent: May 31, 2016

(54) SOFA BED WITH FACILITATED OPENING, PARTICULARLY WITH AUTOMATIC ACTUATION

(71) Applicant: Dionisio Baldassarra, Altamura (IT)

(72) Inventor: Dionisio Baldassarra, Altamura (IT)

(73) Assignee: Comodo Italia S.R.L., Altamura (IT)

( * ) Notice: Subject to any disclaimer, the term of this patent is extended or adjusted under 35 U.S.C. 154(b) by 20 days.

(21) Appl. No.: 14/369,224

(22) PCT Filed: Sep. 17, 2012

(86) PCT No.: PCT/EP2012/068259

§ 371 (c)(1),
(2) Date: Jun. 27, 2014

(87) PCT Pub. No.: WO2013/102502

PCT Pub. Date: Jul. 11, 2013

(65) Prior Publication Data

US 2014/0373272 A1 Dec. 25, 2014

(30) Foreign Application Priority Data

Jan. 2, 2012 (IT) ..... MI2012A0001

(51) Int. Cl.
*A47C 17/22* (2006.01)
*A47C 17/04* (2006.01)
(Continued)

(52) U.S. Cl.
CPC ..... *A47C 17/225* (2013.01); *A47C 17/04* (2013.01); *A47C 17/175* (2013.01); *A47C 17/1756* (2013.01); *A47C 17/20* (2013.01)

(58) Field of Classification Search
CPC ..... A47C 17/04; A47C 17/22; A47C 17/225; A47C 17/175; A47C 17/16; A47C 17/162; A47C 17/165; A47C 17/17; A47C 17/1756; A47C 17/20; A47C 17/207; A47C 17/2076
See application file for complete search history.

(56) References Cited

U.S. PATENT DOCUMENTS 2,972,753 A * 2/1961 Thomas ..... A47C 17/22 5/13
2,982,974 A * 5/1961 Bronstien ..... A47C 17/22 5/13

(Continued)

FOREIGN PATENT DOCUMENTS

WO WO03049579 6/2003
WO WO2010091792 8/2010
WO WO 2010091792 A1 * 8/2010 ..... A47C 17/22

OTHER PUBLICATIONS

International Search Report dated Jan. 3, 2013; International Application No. PCT/EP2012/068259; International Filing Date: Sep. 17, 2012; 5 pages.

*Primary Examiner* — Nicholas Polito
*Assistant Examiner* — David R Hare
(74) *Attorney, Agent, or Firm* — Blank Rome LLP

(57) ABSTRACT

A sofa bed (1*a*, 1*b*) with facilitated opening, particularly with automatic actuation, comprising a fixed framework (2) which defines a compartment (7) for accommodating a mattress (8) that can fold into at least four parts and is supported by at least four movable frames (9, 10, 11, 12), one for each one of the parts of the mattress (8), the first movable frame (9) being associated with the fixed framework (2); the four movable frames (9, 10, 11, 12) are mutually articulated sequentially with respect to each other to define a kinematic chain, with one degree of freedom, which can move between a closed configuration, in which the four movable frames (9, 10, 11, 12) are substantially mutually opposite in pairs so as to define a cage-like structure that encloses the mattress (8) folded into at least four parts, and an open configuration, in which the four movable frames (9, 10, 11, 12) are substantially mutually aligned to define a resting surface on which the unfolded mattress (8) lies; motor means (13) are also provided which are associated with the fixed framework (2) and are functionally connected to the four movable frames (9, 10, 11, 12) for their movement between the open configuration and the closed configuration, the motor means (13) comprising at least one linear actuator (18), which operates along a straight line of action (19) which is substantially parallel to the unfolding direction of the movable frames (9, 10, 11, 12), the linear actuator (18) being pivoted to the fixed frame (2) and being functionally associated with the movable frames (9, 10, 11, 12) by a plurality of levers (24, 26, 29, 32) which are interconnected and are associated with the movable frames (9, 10, 11, 12).

15 Claims, 18 Drawing Sheets

(51) Int. Cl.
*A47C 17/175* (2006.01)
*A47C 17/20* (2006.01)

(56) References Cited

U.S. PATENT DOCUMENTS 3,056,973 A * 10/1962 Keller ..... A47C 17/22 5/13
3,299,445 A 1/1967 Steffan
4,625,345 A * 12/1986 Wood ..... A47C 17/225 5/13
5,815,857 A * 10/1998 De Lorenzo ..... A47C 17/20 5/13
8,387,176 B2 * 3/2013 Contreras ..... A47C 17/161 5/18.1
2003/0088916 A1 * 5/2003 De Lorenzo ..... A47C 17/20 5/13

* cited by examiner

SOFA BED WITH FACILITATED OPENING, PARTICULARLY WITH AUTOMATIC ACTUATION

The present invention relates to a sofa bed with facilitated opening, particularly with automatic actuation.

Currently, a plurality of mechanical solutions are known which allow converting an armchair or a sofa into a bed and vice versa. The purpose of these mechanisms is to make this conversion as simple and safe as possible.

In particular, mechanisms are known which allow the user to convert a sofa or an armchair into a bed in a simple and intuitive manner. These mechanisms are generally composed of a supporting fixed framework, which defines a compartment in which the movable part of the mechanism is accommodated when it is folded in the sofa configuration, and four mutually pivoted movable frames, which can move between a closed configuration, i.e., the sofa configuration, in which they form an angle of approximately 90° with respect to each other, and an open configuration, i.e., the bed configuration, in which they are arranged with an angle of 180° with respect to each other so as to form the resting surface on which the mattress rests. Such mattress, when one passes to the closed configuration, is folded in a plurality of parts by the movable frames and transported inside the compartment defined by the fixed framework.

Moreover, rigid structures of the sofa, such as arms and front and rear covering vertical panels, can be fitted on the fixed framework. The cushions of the seat of the sofa are instead fitted directly to the last movable frame but from the side opposite to the mattress or in any case always in the same position, but on a secondary frame moved by the mechanism. The cushions of the back, finally, are anchored by means of a bracket to said mechanism.

From the kinematic point of view, the relative movements between the several frames, brackets and secondary frames are controlled by suitable synchronizing mechanisms, which are all mutually connected, so that the degree of freedom of the entire system is singular. In other words, in order to pass from the closed configuration to the open configuration and vice versa, the user has to perform one single operation, because the mechanism synchronizes conveniently the movement of each movable frame so that at the beginning and at the end there are the open and closed configurations cited above.

It should be specified that in the closed configuration the mattress is folded inside the fixed structure, while the seat and back cushions are arranged according to suitable angles over the movable frames.

In the open configuration, instead, the mattress is spread on the movable frames that form the resting surface, while the seat and back cushions are arranged one against the other, under the resting surface.

This arrangement allows the user to convert a sofa into a bed, complete with a mattress, by performing one single action, and without having to remove the seat and back cushions from their initial position.

In order to convert the sofa into a bed, in fact, the user, placed in front of the sofa, pulls toward him the back cushions, which will arrange themselves against the seat cushions. At the same time, the movable frames will start to exit from the fixed framework, so as to allow the user to grip the end of the last frame and continue pulling. In the last step the user supports the end of the bed up to the complete opening of the mechanism, when a support, started by the same mechanism, rests on the ground.

With the same ease, in order to close the mechanism, the user, by lifting the end of the bed, allows the mechanism to fold said movable frames and said mattress, inside the sofa or armchair. The user completes the operation by pushing on the back until it reaches the initial position.

All the mechanisms described above have a common characteristic that consists in having a configuration of levers that, when the mechanism is closed in the sofa configuration, by moving beyond a dead center do not allow the opening of the mechanism from the inside due to the thrust of the mattress. The only way to open the mechanism is to act on the back from outside. The same applies to the bed position, in which some hinges are aligned, or almost aligned, with the purpose of preventing or almost preventing the spontaneous closure of the mechanism when the bed is loaded. In this way, the only manner to close the mechanism is to lift the end of the bed.

All these mechanisms, moreover, are provided with some elastic elements and mechanisms that reduce the force required by the user in order to perform the opening and closing operation. Obviously, this force can never be nil, otherwise there would be no stable positions for the mechanism.

An evolution of the mechanisms with manual opening described above consists in providing them with automatic opening devices such as to limit to a minimum the intervention of the operator for the transition from one configuration to the other.

These mechanisms, however, despite having only one degree of freedom, cannot be actuated from points other than the one described above and therefore cannot be actuated for example by means of a single actuator arranged in the base.

In fact, at least two actuators are needed, interfaced conveniently so as to start at different times and have speeds compatible with the ones imposed by the mechanism, despite the mechanism having one single degree of freedom.

If one wanted to adapt the degrees of freedom of the mechanisms to the number of actuators introduced, said mechanisms would have to be converted, thus obtaining two degrees of freedom, each driven by an actuator, obviating the drawback described above.

These solutions of the known type suffer drawbacks, including the fact that even if they can be provided they are economically onerous and scarcely reliable.

In fact, in mechanisms that use these solutions with two actuators, during opening, the first actuator actuates the mechanism of the back, which as already noted is also the one that keeps the mattress compressed and prevents the spontaneous opening of the mechanism. Only after this first step a second actuator, arranged in the fixed framework, intervenes and completes the opening movement while the first one collaborates, adapting its own speed.

In order to achieve synchronization between the movements of the two actuators one relies on electric limit switches or actuators provided with encoders, i.e., actuators that have a feedback on the reached position. A certainly simpler solution is to separate the movement for folding the back cushions onto the seat cushions and the consequent tilting of the movable frames from the movement for lifting and extending the frames from the inside of the fixed framework. In this case the actuators are always two in number and have to start in any case with preset timings, so as to avoid interferences with the fixed structure of the sofa, but they do not need to have speeds that are consistent with those set by kinematics with one single degree of freedom.

The presence of two actuators, however, complicates these mechanisms considerably, from the constructive point of view. One must consider, in fact, that the first actuator, arranged inside the back, when the bed configuration is reached, arranges itself, together with the back, below the plane of the bed, at its end, and therefore very far from the fixed framework.

The electrical connection, therefore, must travel along all the movable frames, until it reaches the fixed framework, where the power supply and control unit is arranged. This obviously entails some contraindications, and specifically the need to conceal the electric cable for aesthetic purposes and especially the need to use a cable that can withstand continuous bending and stretching during the movement of the movable frames.

Moreover, a compartment is provided, usually in the back, which is adapted to store the pillows, and this compartment is occupied partially by the actuator, which needs to be concealed for aesthetic reasons and to avoid dirtying the pillows.

One must also not neglect the fact that if one of the actuators stops while the other one continues its stroke, breakages of the mechanism may occur in addition to safety problems due to the unpredictability of the path followed by the mechanism itself, because only part of the mechanism follows its stroke, while the other part remains in the last reached position.

Another drawback of these solutions of the known type resides in that these mechanisms, being derived directly from the corresponding ones with manual opening, must overcome the resistance moments that derive from the point of application of the forces. In fact, differently from the actuator arranged in the back, which is capable of simulating the force applied by the user to the same element, the actuator arranged in the fixed framework has a point of application that is completely different from the one of the user. If one considers the closing of the mechanism, the user in fact grips the end of the last movable frame and lifts it, allowing the movable frames to fold with respect to each other. The actuator arranged in the fixed framework instead operates from the other end of the kinematic chain, with distinctly greater forces. In practice, while the user utilizes a very long lever arm by performing a very broad movement, the actuator arranged in the fixed framework would have to perform the same work but with lever arms that are definitely shortened and therefore have small movements, with the consequent intense forces involved.

All this leads to the use of very powerful actuators and to very intense stresses induced on the mechanism, with consequent loss of reliability thereof.

The aim of the present invention is to provide a sofa bed with facilitated opening, particularly with automatic actuation, that has a mechanism whose operation is substantially similar to those described previously with an automatic actuation by means of a single electric actuator, solving and overcoming, respectively, the drawbacks and the limitations of the background art.

Within this aim, an object of the present invention is to provide a sofa bed with facilitated opening that allows the user to pass from the sofa configuration to the bed configuration and vice versa simply by pushing a button.

Another object of the present invention is to provide a sofa bed with facilitated opening that is economically advantageous if compared to the background art.

This aim and these and other objects that will become more apparent hereinafter are achieved by a sofa bed with facilitated opening, particularly with automatic actuation, comprising a fixed framework which defines a compartment for accommodating a mattress that can fold into at least four parts and is supported by at least four movable frames, one for each one of said parts of said mattress, the first movable frame of which is associated with said fixed framework, said at least four movable frames being mutually articulated sequentially with respect to each other to define a kinematic chain, with one degree of freedom, which can move between a closed configuration, in which said at least four movable frames are substantially mutually opposite in pairs in order to define a cage-like structure that encloses said mattress folded into at least four parts, and an open configuration, in which said at least four movable frames are substantially mutually aligned to define a resting surface on which said unfolded mattress lies, motor means being also provided which are associated with said fixed framework and are functionally connected to said at least four movable frames for their movement between said open configuration and said closed configuration, characterized in that said motor means comprise at least one linear actuator which operates along a straight line of action which is substantially parallel to the unfolding direction of said at least four movable frames, said at least one linear actuator being pivoted to said fixed framework and being functionally associated with said at least four movable frames by a plurality of levers which are interconnected and associated with said at least four movable frames.

Further characteristics and advantages of the present invention will become better apparent from the description of two preferred but not exclusive embodiments of a sofa bed with facilitated opening, particularly with automatic actuation, illustrated by way of non-limiting example in the accompanying drawings, wherein.

Figure 1:
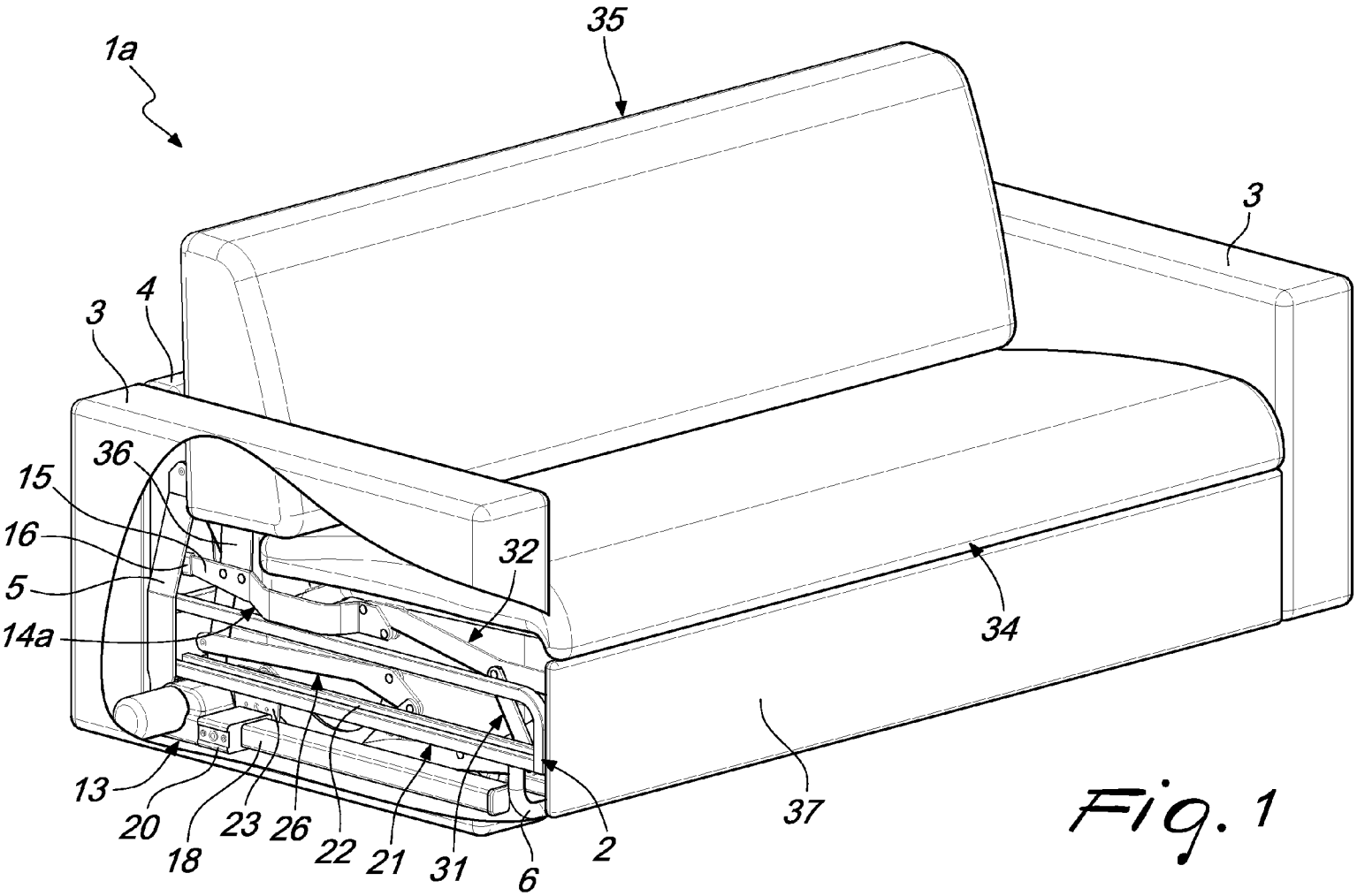
FIG. 1 is a partially cutout perspective view of a first embodiment of the sofa bed with facilitated opening, particularly with automatic actuation, according to the invention, in its closed configuration.
Figure 2:
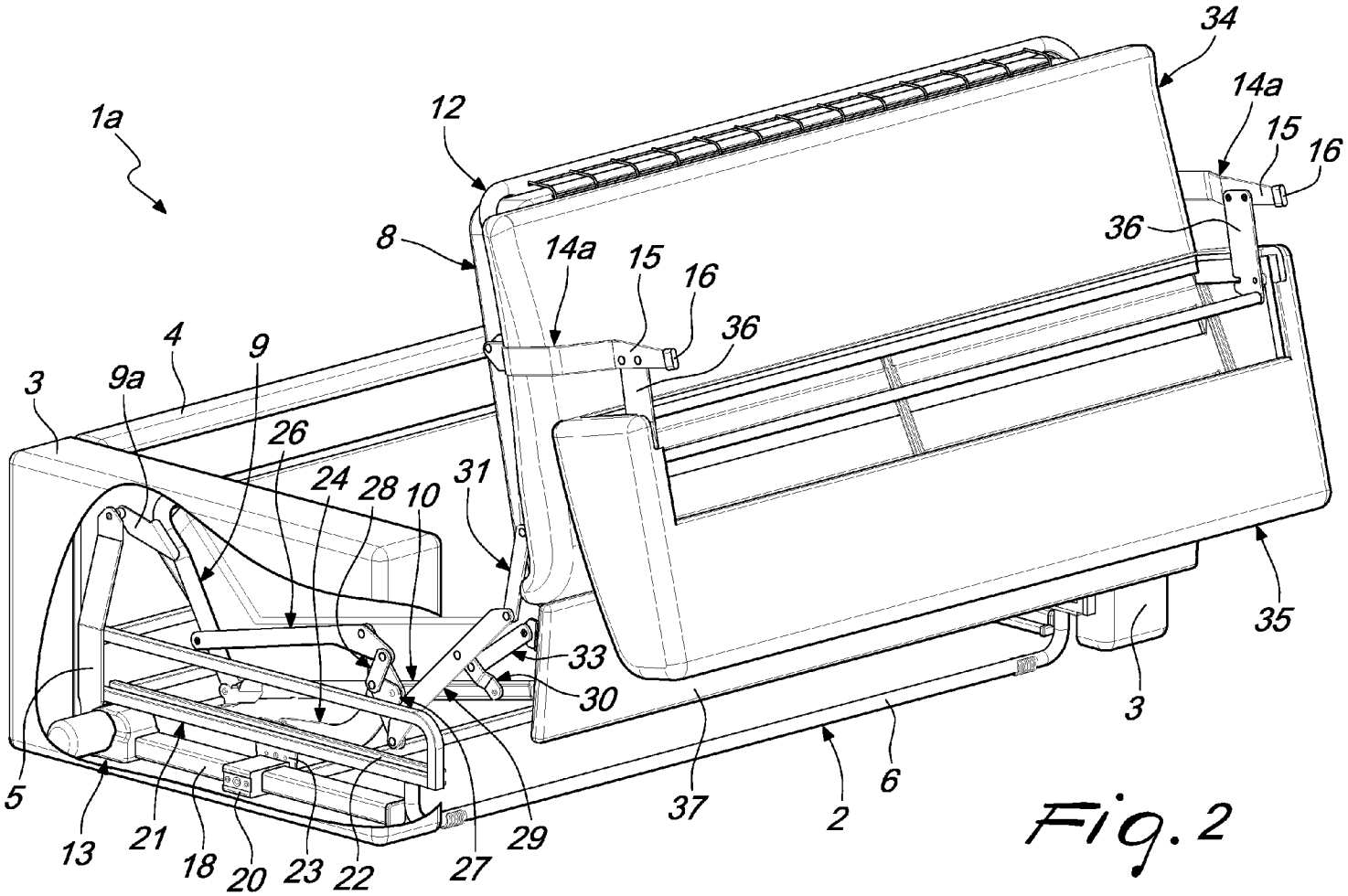
FIG. 2 is a partially cutout perspective view of the sofa bed shown in FIG. 1, in a position which is intermediate between its closed and open configurations.

With reference to the figures, the sofa bed with facilitated opening, particularly with automatic actuation, generally designated in the two proposed embodiments by the reference numerals 1*a* and 1*b*, comprises a fixed framework 2 to which two lateral arms 3 and a rear covering panel 4 are fixed laterally.

More precisely, the fixed framework 2 is substantially L-shaped in a lateral view so as to define a vertical upright 5, which is arranged at the rear portion of the sofa bed 1*a* or 1*b* and to which the rear covering panel 4 is fixed, and a lower footing 6, so as to define, on the side opposite to the rear covering panel 4, a compartment 7 for accommodating a mattress 8 that can be folded in at least four parts and supported by at least four movable frames 9, 10, 11 and 12, one for each part of the mattress 8.

Conveniently, the four movable frames 9, 10, 11 and 12, each of which defines a supporting structure of the mattress 8, which is obtained from wire nets and/or slats and/or elastic bands, are mutually articulated sequentially with respect to each other to define a kinematic chain with one degree of freedom associated with the fixed framework 2 by means of the first movable frame 9 whose free end 9*a* is pivoted to the vertical upright 5.

As will be described in more detail hereinafter, there are also motor means 13 which are associated with the fixed framework 2 and are functionally connected to the four movable frames 9, 10, 11 and 12 for their movement between a closed configuration, in which the four movable frames 9, 10, 11 and 12 are substantially mutually opposite in pairs to define a cage structure that contains the mattress 8 folded in at least four parts, and an open configuration, in which the four movable frames 9, 10, 11 and 12 are substantially mutually aligned for the definition of a resting surface on which the unfolded mattress 8 lies.

Moreover, depending on the considered embodiment, there is at least one fifth movable frame 14*a* or 14*b*, which is associated with the fourth movable frame 12 and defines two supporting legs 15 which can be arranged in the open configuration on the side opposite to the fixed framework 2 so as to support the resting surface on the ground.

Depending on the constructive preferences, the supporting legs 15 can be provided with resting feet 16, as shown in FIGS. 1 to 13 in relation to the first proposed embodiment, or with resting wheels 17, as shown in FIGS. 14 to 18 in relation to the second proposed embodiment.

According to the invention, the motor means 13 comprise at least one linear actuator 18, which operates along a straight line of action 19 that is substantially parallel to the unfolding direction of the movable frames 9, 10, 11 and 12.

More specifically, the linear actuator 18 is pivoted, at one of its ends 18*a*, to the fixed framework 2 and is functionally associated with the movable frames 9, 10, 11 and 12 by means of a plurality of levers 24, 26, 29 and 32 which are interconnected and are associated, in turn, with the movable frames 9, 10, 11 and 12.

More precisely, the linear actuator 18 is fixed to the lower footing 6 so as to move a slider 20 that can move parallel to a straight guide 21 defined by said lower footing 6.

The straight guide 21 is defined by a horizontal track 22 in which an actuation bracket 23 is accommodated slidingly and is integral in translational motion with the slider 20 and pivoted to one end 24*a* of a first lever 24, the function of which will be explained in more detail hereinafter.

The actuation bracket 23 is therefore the connecting element between the mechanism responsible for the kinematics of the movable frames 9, 10, 11, 12 and 14*a* or 14*b* and the linear actuator 18.

In fact, the linear actuator 18 is pivoted in a fixed point of the lower footing 6 and the actuation bracket 23, which is integral in translational motion with the slider 20, is blocked in the horizontal track 22, providing a carriage-like constraint. In other words, when the linear actuator 18 is actuated, the slider 20 moves forward or backward the actuation bracket 23, which slides in the horizontal track 22.

In order to reduce frictions, the actuation bracket 23 slides in the horizontal track 22 by means of a pair of bearings 25, or in any case of technically equivalent elements.

Conveniently, the actuation bracket 23, the bearings 25 and the horizontal track 22 are all components that make it possible to avoid stressing in an anomalous manner the linear actuator 18. From the merely kinematic point of view, in fact, it is sufficient to block rigidly the linear actuator 18 on the lower footing 6 and to pivot the first lever 24 directly to the slider 20. This configuration, however, would stress the linear actuator 18 also with forces at right angles to the advancement direction, forces for which the linear actuator 18 might not be designed.

In summary, in order to actuate the mechanism, one relies on a linear actuator 18, arranged in the fixed framework 2 on one of the two sides of the mechanism, while the opposite side follows the same movement, induced by the several connecting elements provided on the movable frames 9, 10, 11, 12 and 14*a* or 14*b*, and on all the other transverse components of the sofa bed 1*a* and 1*b*.

This does not eliminate the possibility of inserting a second linear actuator, identical to the first one, on the opposite side of the mechanism, so as to double the actuation force and distribute in a more balanced manner the forces on the two sides of the sofa bed 1*a* and 1*b*.

Before going into further detail of the entire mechanism responsible for the kinematics of the movable frames 9, 10, 11, 12 and 14*a* or 14*b*, it should be stressed that the figures, which are side views of the sofa beds 1*a* and 1*b*, are sufficient to describe the operation of the mechanism, because the movement follows a two-dimensional trajectory. For this reason, the levers that extend on one side of the mechanism are capable of describing the movement on their own. It is implied, however, that on the opposite side there is a mirror-symmetrical duplicate.

As previously introduced, in both of the proposed embodiments the first lever 24 is associated with the slider 20 by means of its end 24*a* pivoted to the actuation bracket 23, which is integral in translation with the slider 20.

At its other end 24*b* and at its intermediate portion 24*c*, the first lever 24 is pivoted, respectively, to an intermediate portion 26*c* of a second lever 26 and to an intermediate portion of the second movable frame 10.

Moreover, the second lever 26 is instead pivoted with one of its ends 26*a* to an intermediate portion of the first movable frame 9.

In this manner, with the advancement of the slider 20 in the direction for unfolding the mattress 8, the second movable frame 10 undergoes a substantial translation that makes it advance, rise until it is arranged horizontally and define part of the resting surface of the mattress 8.

At the same time, the first movable frame 9 is moved by means of the second lever 26, rotating about its pivoting point with the vertical upright 5 until it is arranged horizontally, also defining part of the resting surface of the mattress 8.

Moreover, a substantially L-shaped transmission lever 27 is pivoted, at the vertex 27*c* of said L-shape, to the first lever 24 substantially at the pivoting point defined between said first lever 24 and the second movable frame 10.

The coaxial arrangement of the pivoting defined between the transmission lever 27 and the first lever 24 on the one hand and the pivoting defined between the first lever 24 and the second movable frame 10 on the other hand is not indispensable, but it is sufficient for the transmission lever 27 to be pivoted to the first lever 24 in a point that is close to the pivoting point of said first lever 24 to the second movable frame 10.

The ends 27*a*, 27*b* of the transmission lever 27 are further pivoted, respectively, to a first linkage 28, which in turn is pivoted to the other end 26*b* of the second lever 26, and to an end 29*a* of a third lever 29, which is associated with the third movable frame 11 and with the fourth movable frame 12 for the combined rotation and translation of said frames until their horizontal position is reached, so as to complete the resting surface of the mattress 8.

This configuration causes a rotation of approximately 90° of the first lever 24 with respect to the second movable frame 10 to correspond to a rotation of approximately 180° of the transmission lever 27 with respect to said second movable frame 10.

More precisely, the third lever 29 is pivoted at an intermediate portion thereof 29*c* to a second linkage 30, which in turn is pivoted to the second movable frame 10 proximate to the pivoting point between said second movable frame 10 and the third movable frame 11.

The other end 29*b* of the third lever 29 is pivoted to a third linkage 31, which in turn is pivoted to an intermediate portion 32*c* of a fourth lever 32, which is associated with the third movable frame 11 and with the fifth movable frame 14*a* or 14*b* to cause the rotation of the latter with respect to the previous one so as to arrange the supporting legs 15 substantially in a vertical position with respect to the floor.

Moreover, the second linkage 30 is pivoted, by means of an intermediate portion thereof, to a fourth linkage 33, which in turn is pivoted to an intermediate portion of the third movable frame 11.

The fourth lever 32 is pivoted at its ends 32*a* and 32*b* respectively to the third movable frame 11 between the pivoting point to the fourth linkage 33 and the pivoting point to the fourth movable frame 12 and to the fifth movable frame 14*a* or 14*b*.

Moreover, to complete the sofa beds 1*a* and 1*b*, for each one of them there are cushions of the seat 34 which are associated with the fourth movable frame 12 on the side opposite to the mattress 8.

With particular reference to FIGS. 1 to 13, in the first proposed embodiment the sofa bed 1*a* comprises a back 35 which is integral with the fifth movable frame 14*a*, which is constituted substantially by the supporting legs 15, by means of a supporting bracket 36 which is integral and substantially at right angles to the fifth movable frame 14*a*, which is pivoted to the fourth movable frame 12.

Also in the first embodiment, there is a front covering panel 37, which is associated with the third movable frame 11 on the side opposite to the mattress 8 by means of an articulated quadrilateral structure 38 provided by the third movable frame 11, by a protruding tab 39 of the fourth lever 32 which is defined proximate to the third movable frame 11 and is pivoted to a support 41, which supports rigidly the front covering panel 37, and by a fifth linkage 40, which is pivoted by means of its ends respectively to the support 41 and to the third movable frame 11 substantially at its pivoting point to the second movable frame 10.

This first embodiment of the mechanism has the advantage of being very simple and is particularly suitable if the cushions of the seat 34 and the back 35 are not very thick. In fact, in the open configuration, i.e., the bed configuration, the thicker part of the back 35 is compressed against the thicker part of the cushions of the seat 34. For reducing this compression, the front covering panel 37 is anchored to the support 41, which is moved by means of the fourth lever 32, so as to prevent the cushions of the seat 34 from being compressed between the back 35 and the front covering panel 37.

With particular reference to FIGS. 14 to 18, in the second proposed embodiment the sofa bed 1*b* comprises a back 42, which is integral with the fifth movable frame 14*b*, which is also constituted substantially by the supporting legs 15, the end 32*b* of the fourth lever 32 being pivoted to the fifth movable frame 14*b* which is substantially C-shaped so as to partially surround the cushions of the seat 34 at the rear.

There is a fifth lever 43, which is pivoted at its ends 43*a*, 43*b* to the fourth movable frame 12 and to a sixth linkage 44, which in turn is pivoted to an intermediate portion of the fifth movable frame 14*b*.

More precisely, the intermediate portion 43*c* of this fifth lever 43 is pivoted to the central portion 45 of the substantially C-shaped end 32*b* of the fourth lever 32 for the rotation of the back 42 in the transition from the closed configuration to the open configuration and vice versa.

As can be inferred from the figures, in this embodiment the fourth lever 32 is provided in two pieces, one for each end 32*a* and 32*b*, but nothing prevents providing it in a single piece.

In this case, the front covering panel, which in this embodiment is designated by the reference numeral 46, is fixed directly to the third movable frame 11 on the side opposite to the mattress 8.

This does not prevent the possibility of using the same mechanism as the first embodiment, although in this case it does not have the same usefulness. Moreover, in the first embodiment, too, one may consider rigidly fixing the front covering panel 37 to the third movable frame 11.

This second embodiment, whose operation is practically equivalent to the operation of the first embodiment, allows gathering the supporting legs 15 in a smaller space, when the mechanism is in the closed configuration, i.e., the sofa configuration, and therefore in the open configuration, i.e., the bed configuration, the back 42 is moved toward the end of said bed.

In this manner, the space for the cushions of the seat 34 increases, because the thicker part of the back 42 is compressed against the thinner part of the seat and vice versa.

Moreover, the position of the back 42 allows the cushions of the seat 34 to overlap the front covering panel 46.

It is for this reason that in this second embodiment the support 47 of the front covering panel 46 is anchored rigidly to the third frame 11 and no longer needs to move in order to leave space for the cushions of the seat 34.

This does not eliminate the possibility of using the same articulated quadrilateral 38 as in the first embodiment also for the second one so as to increase further the space available for the cushions of the seat 34.

On the other hand, in the first embodiment also it is possible to consider using the fixed solution, at the expense of the space available to the cushions of the seat 34.

With reference to both of the proposed embodiments, advantageously the backs 35 and 42 are constituted by a framework which is conveniently padded and covered, so as to define internally a compartment for storing pillows or blankets therein. No actuator or mechanical element is arranged in this compartment, as occurs instead in the automated mechanisms of the background art.

Operation of the sofa beds 1*a* and 1*b*, according to the invention, is clear and evident from what has been described so far.

Figure 16:
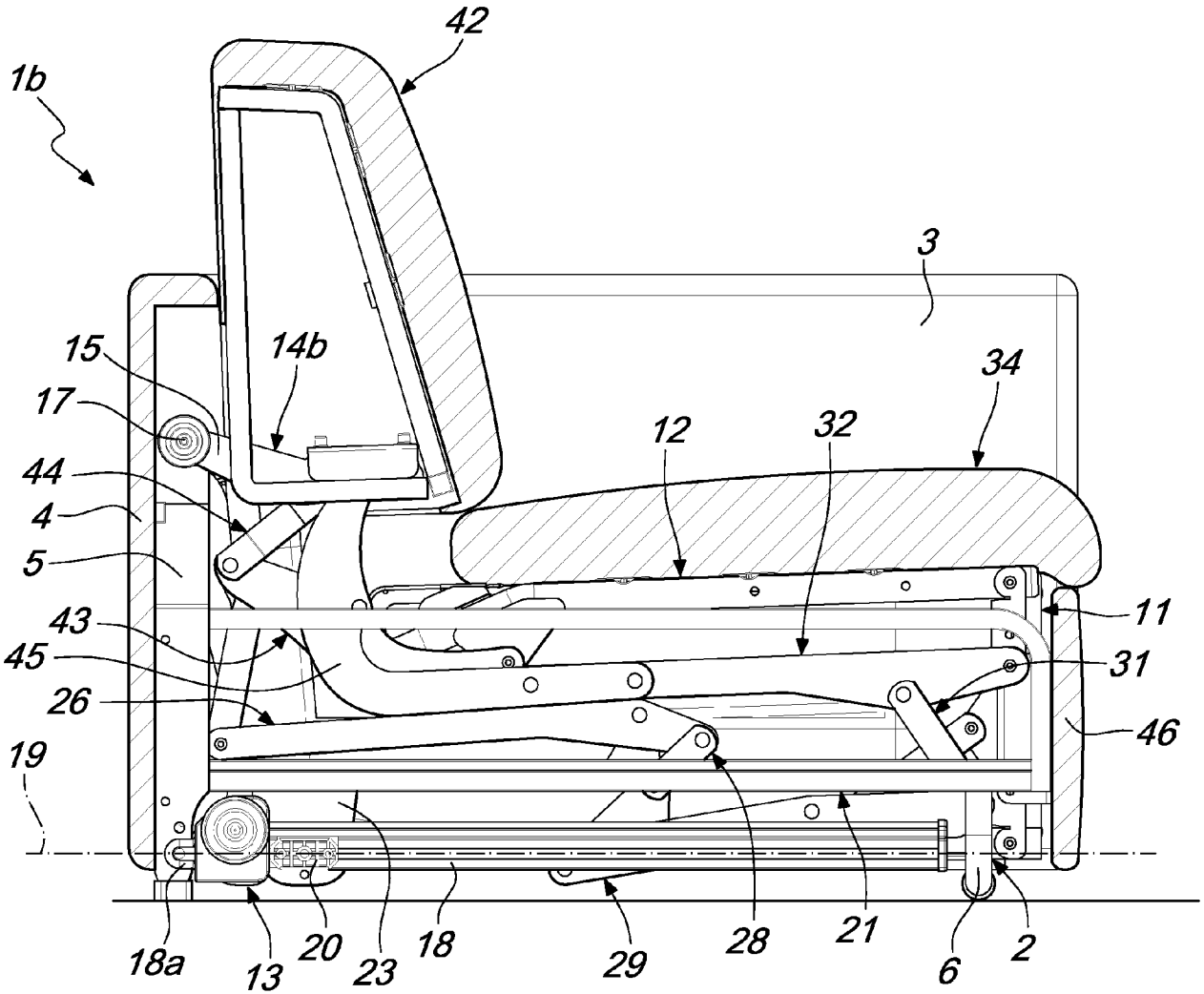
FIGS. 16 to 18 are side views of the sofa bed shown in FIGS. 14 and 15 showing, in a time sequence, the transition from the closed configuration to the open configuration.
Figure 17:
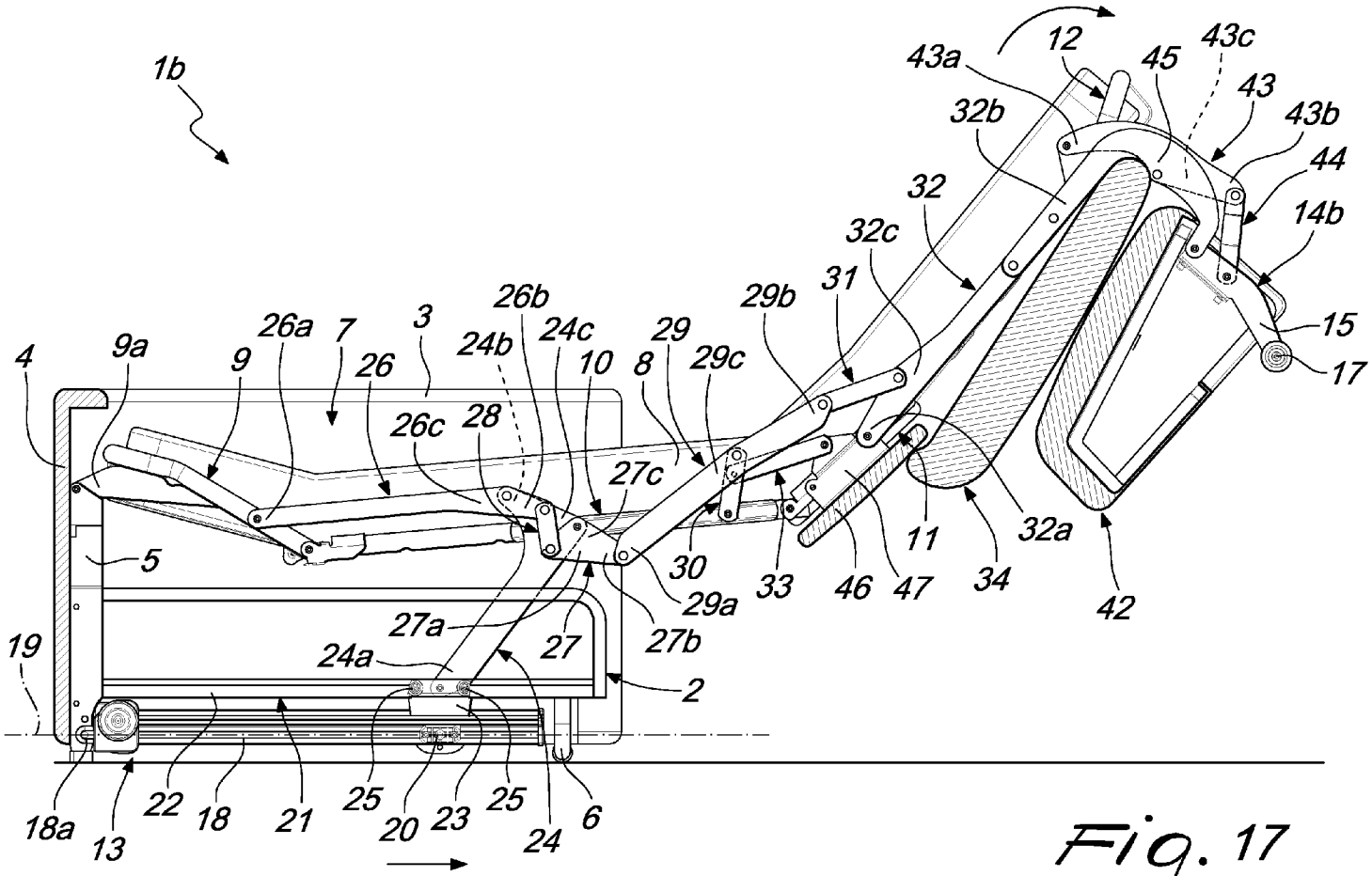
Figure 18:
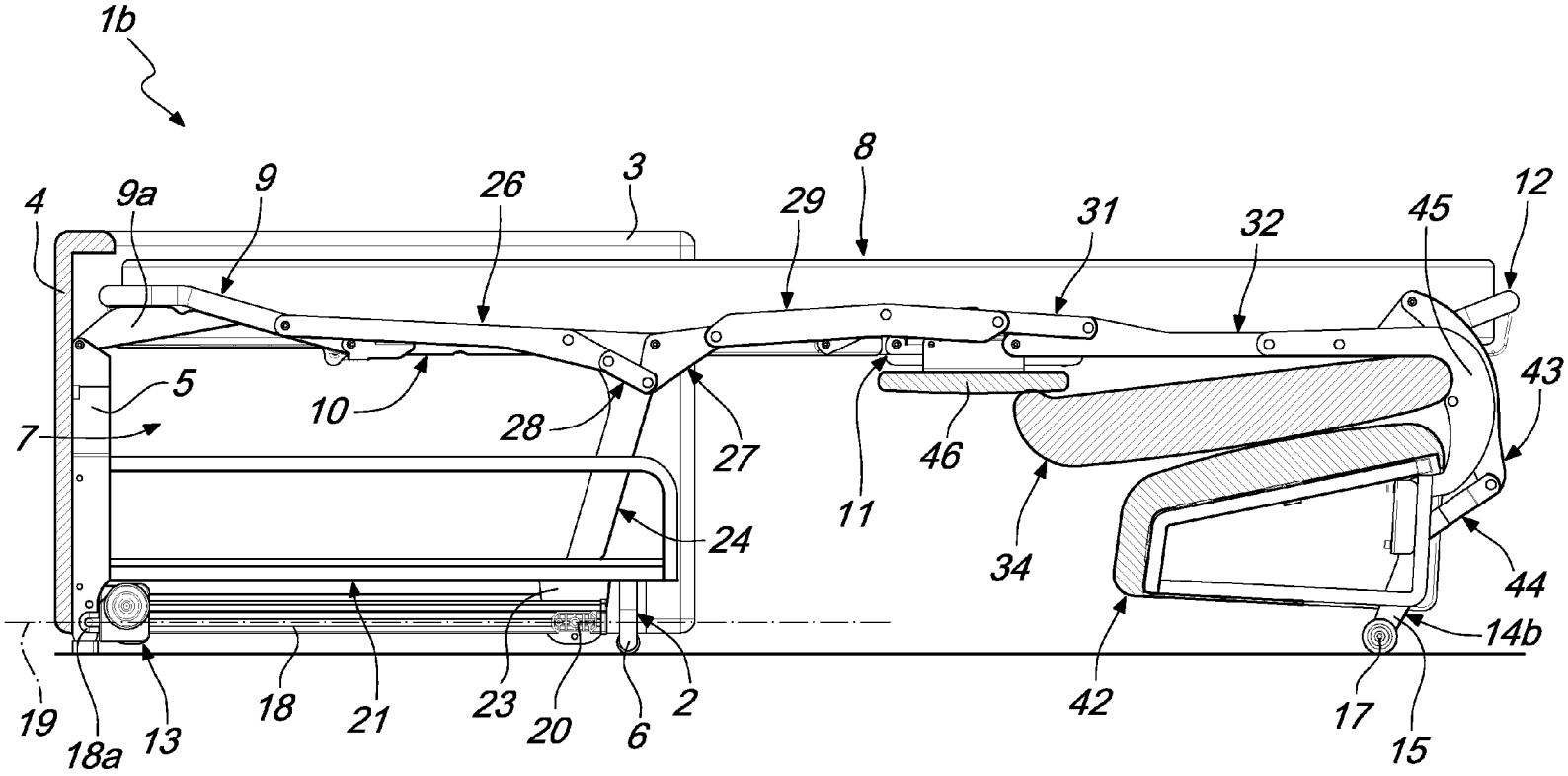

In particular, with reference to FIGS. 7 to 13 and to FIGS. 16 to 18, which show in a time sequence the transition from the closed configuration to the open configuration, respectively in the first embodiment and in the second embodiment, the linear actuator 18, by operating on the actuation bracket 23, causes the translation of the pivoting point with the first lever 24, which, guided by the second lever 26, performs a combined rotation and translation movement. This movement turns the first frame 9 and makes the second frame 10 perform a substantial translation movement.

In practice, the second frame 10 rises from its initial position, remaining almost horizontal. At the same time, the third lever 29, actuated by the first linkage 28 and by the transmission lever 27, and guided by the second linkage 30, moves the third frame 11 and the fourth lever 32, by means of the third linkage 31 and the fourth linkage 33.

In this manner, in the first embodiment the fourth lever 32 turns the fifth movable frame 14*a* with respect to the fourth movable frame 12 and the latter with respect to the third movable frame 11.

The same fourth lever 32, thanks to the protruding tab 39, moves the support 41 of the front covering panel 37 with respect to the third movable frame 11 so as to move the front covering panel 37 away from the cushions of the seat 34.

The rotation of the fifth movable frame 14*a*, and therefore of the supporting leg 15, carries with it also the back 35, which is compressed against the cushions of the seat 34.

In this first embodiment, to avoid cutting the cushions of the seat 34, the fifth movable frame 14*a* has such a shape as to penetrate between said cushions of the seat 34 and the lateral armrests 3.

Differently, in the second embodiment, instead, the fifth movable frame 14*b*, as well as the fifth lever 43, pass behind the cushions of the seat 35 and 42, and therefore it is not necessary to provide contours.

Figure 3:
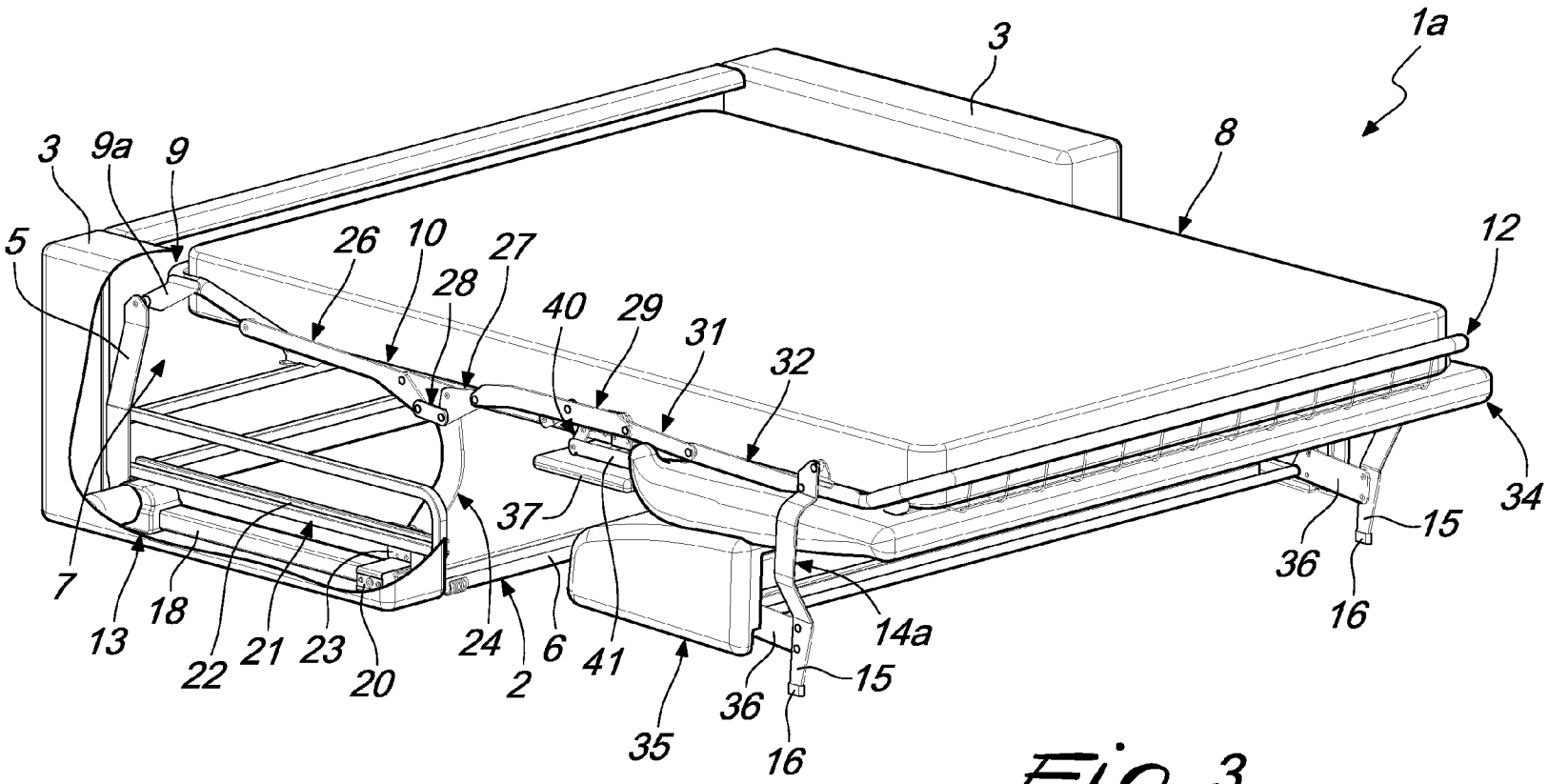
FIG. 3 is a partially cutout perspective view of the sofa bed shown in the preceding figures, in its open configuration.
Figure 4:
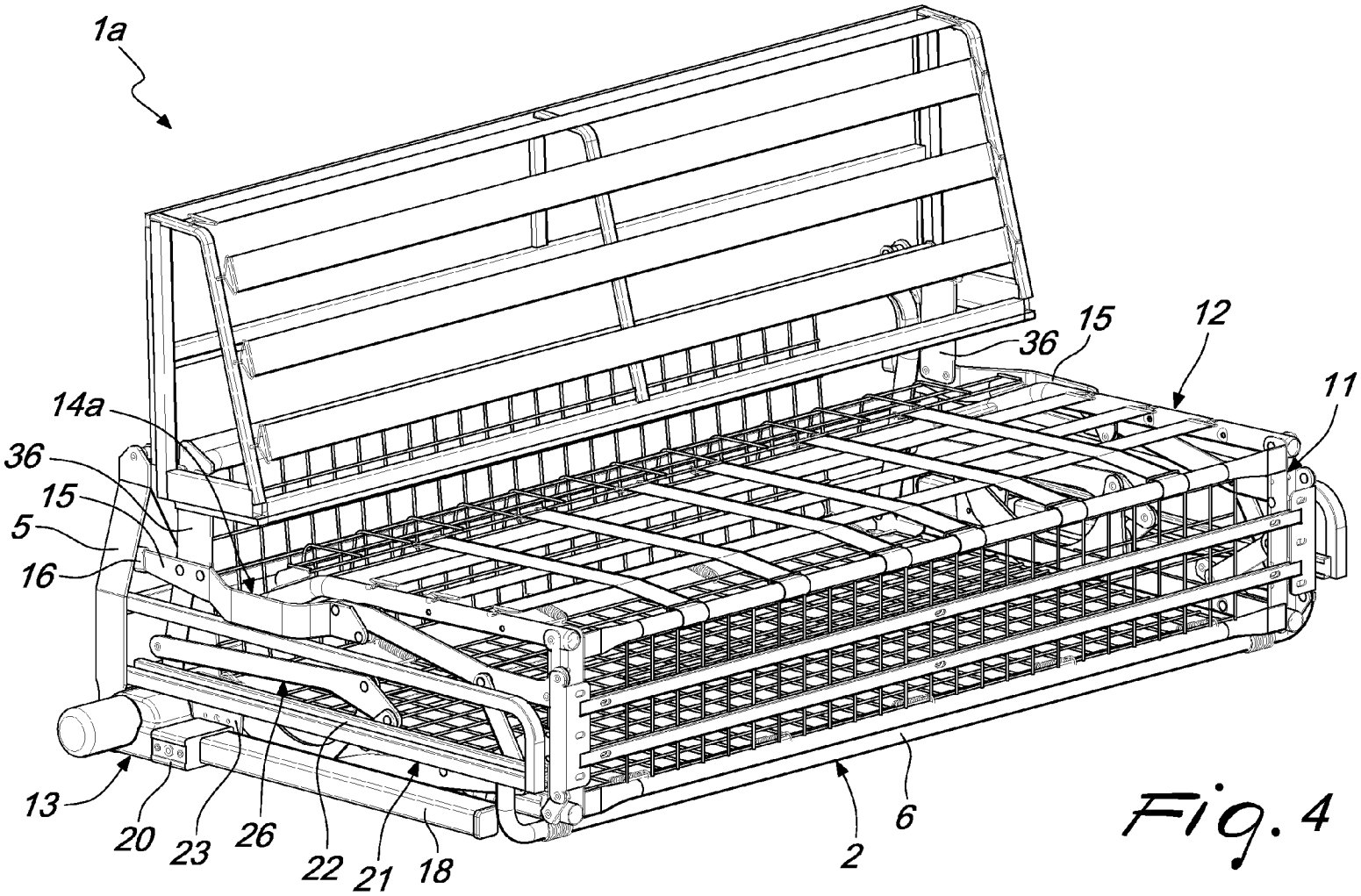
FIG. 4 is a perspective view of the mechanism of the sofa bed shown in the preceding figures, in the closed configuration.
Figure 5:
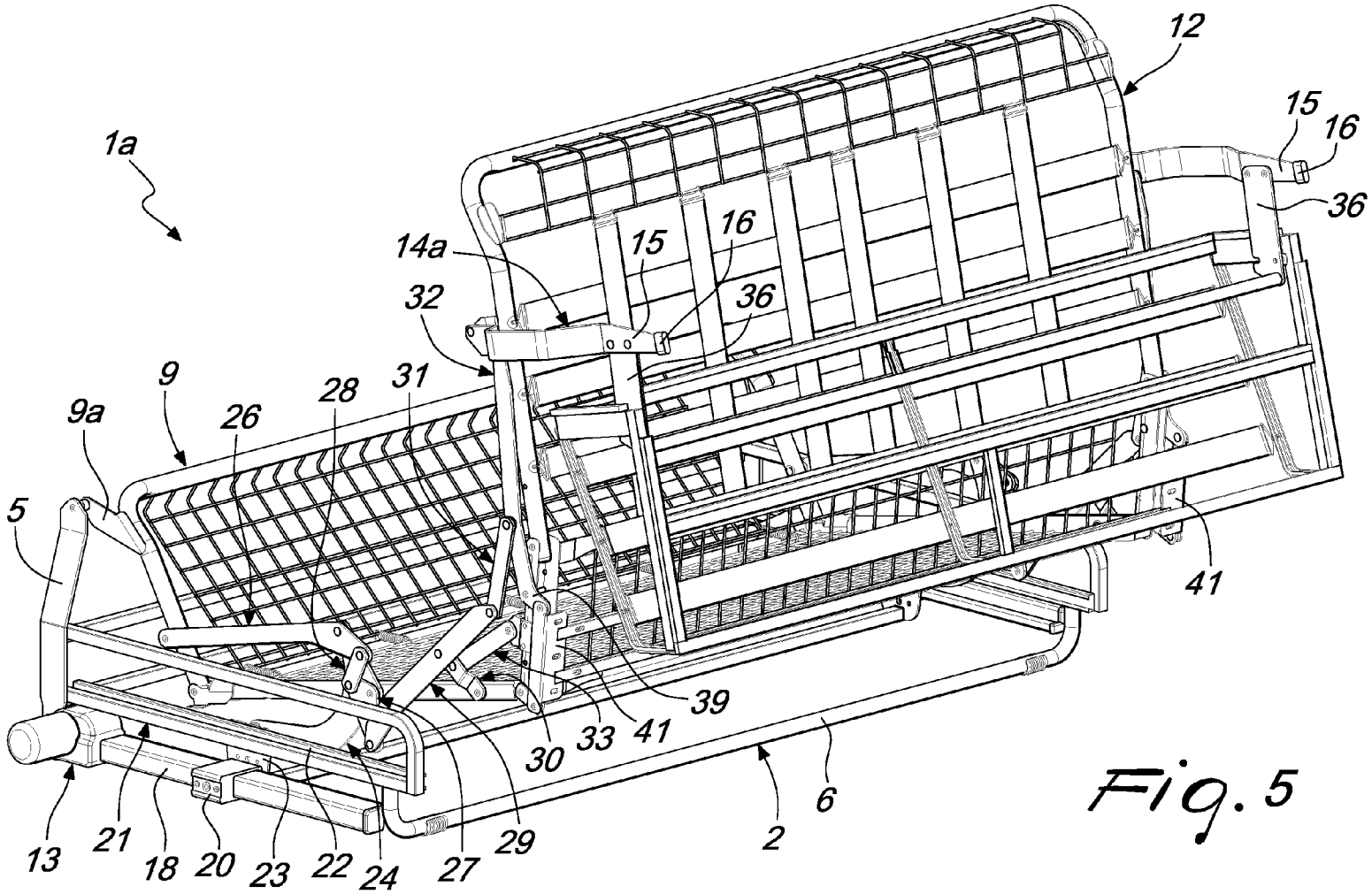
FIG. 5 is a perspective view of the mechanism shown in FIG. 4, in a position which is intermediate between the closed and open configurations of the sofa bed.
Figure 6:
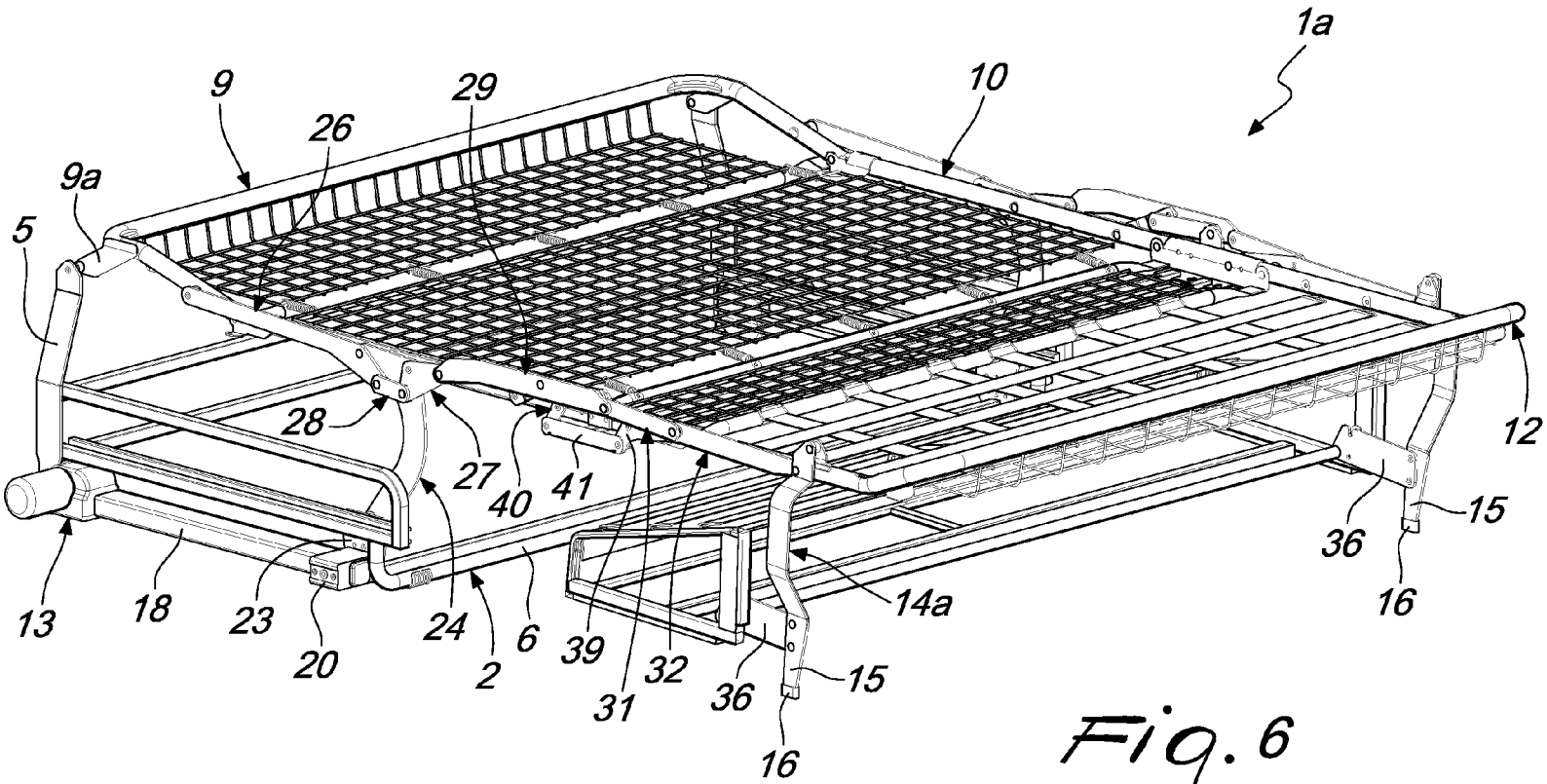
FIG. 6 is a perspective view of the mechanism shown in the previous figures, in the open configuration.
Figure 7:
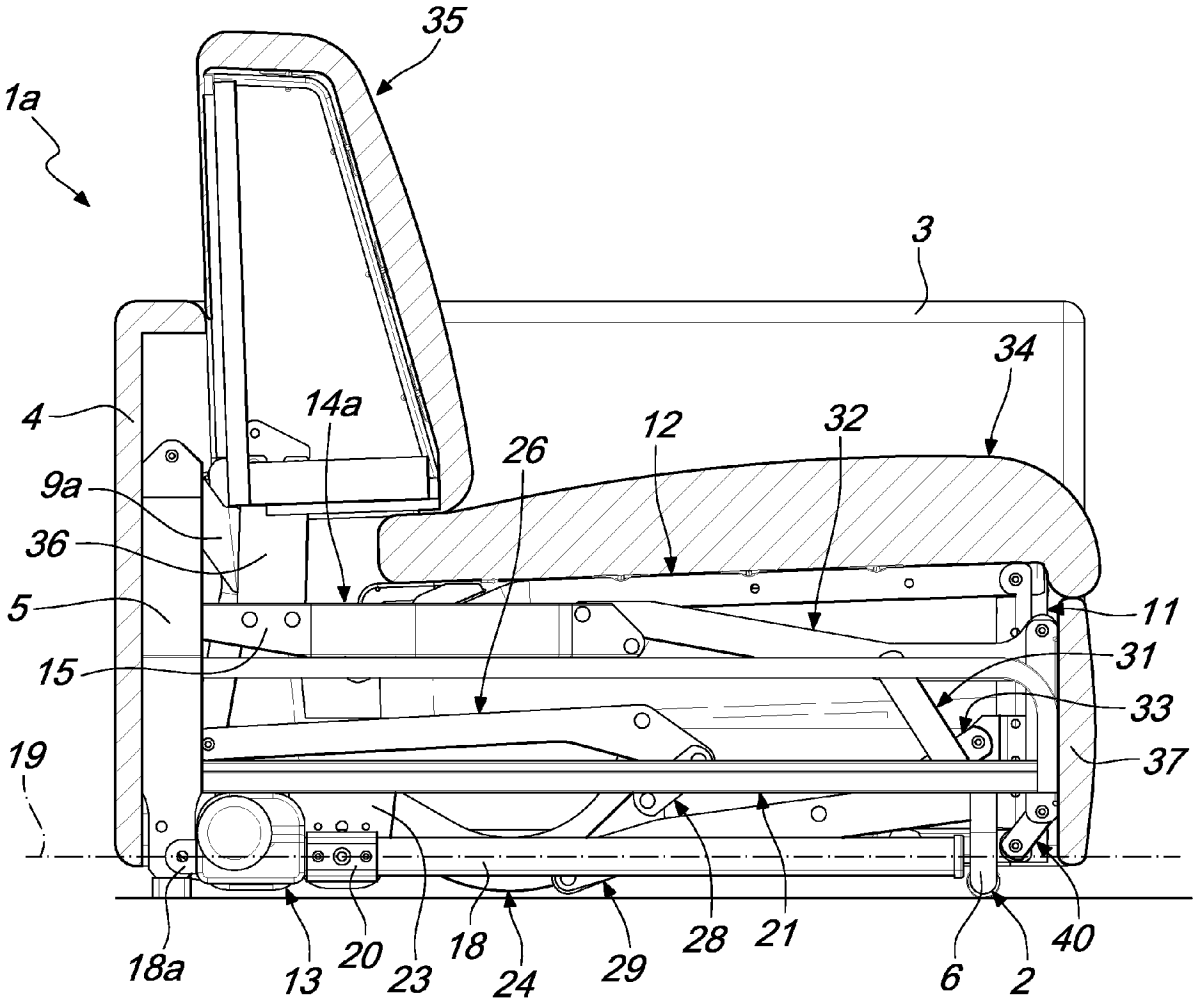
FIGS. 7 to 13 are side views of the sofa bed shown in the preceding figures, showing, in a time sequence, the transition from the closed configuration to the open configuration.
Figure 8:
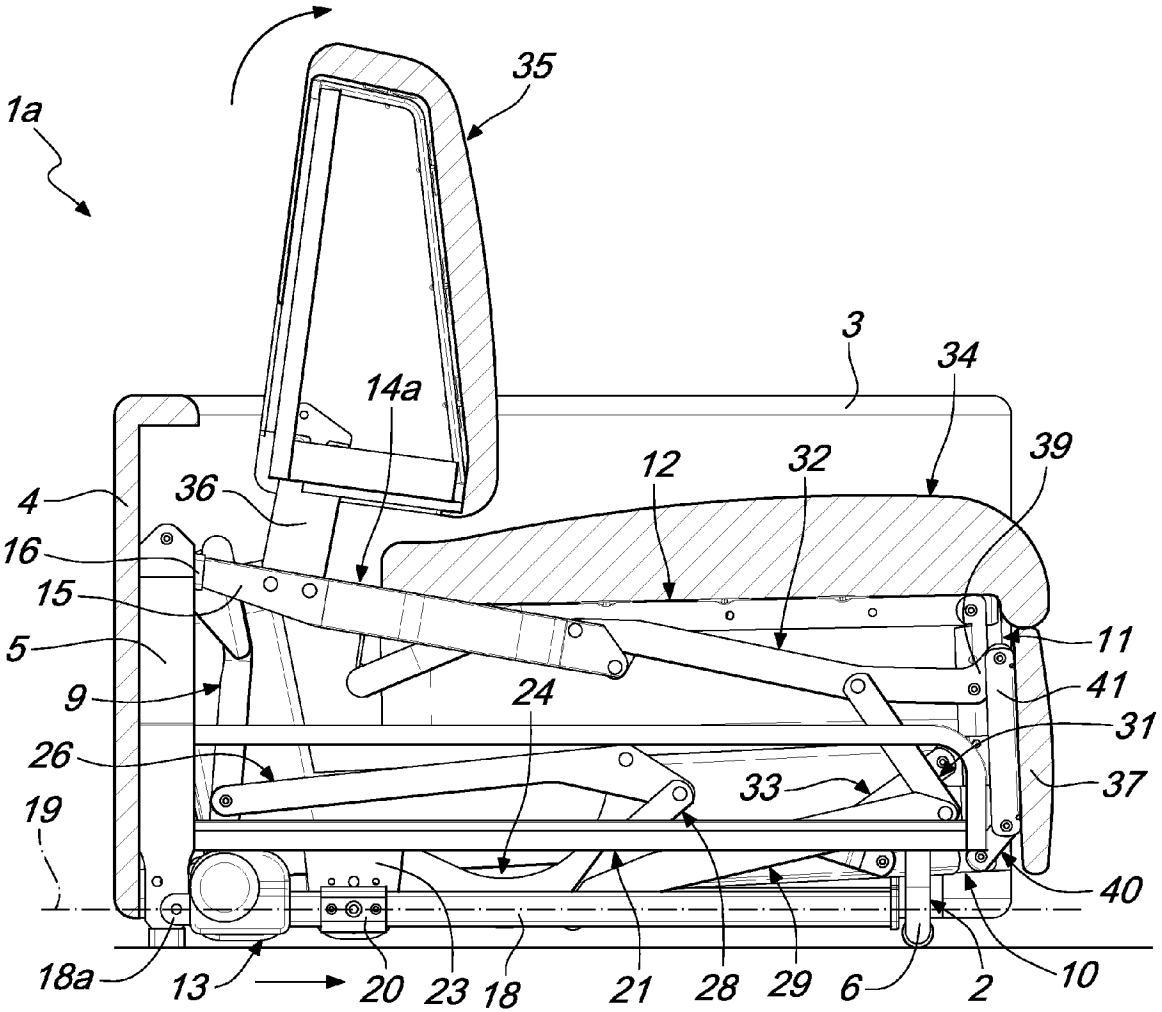
Figure 9:
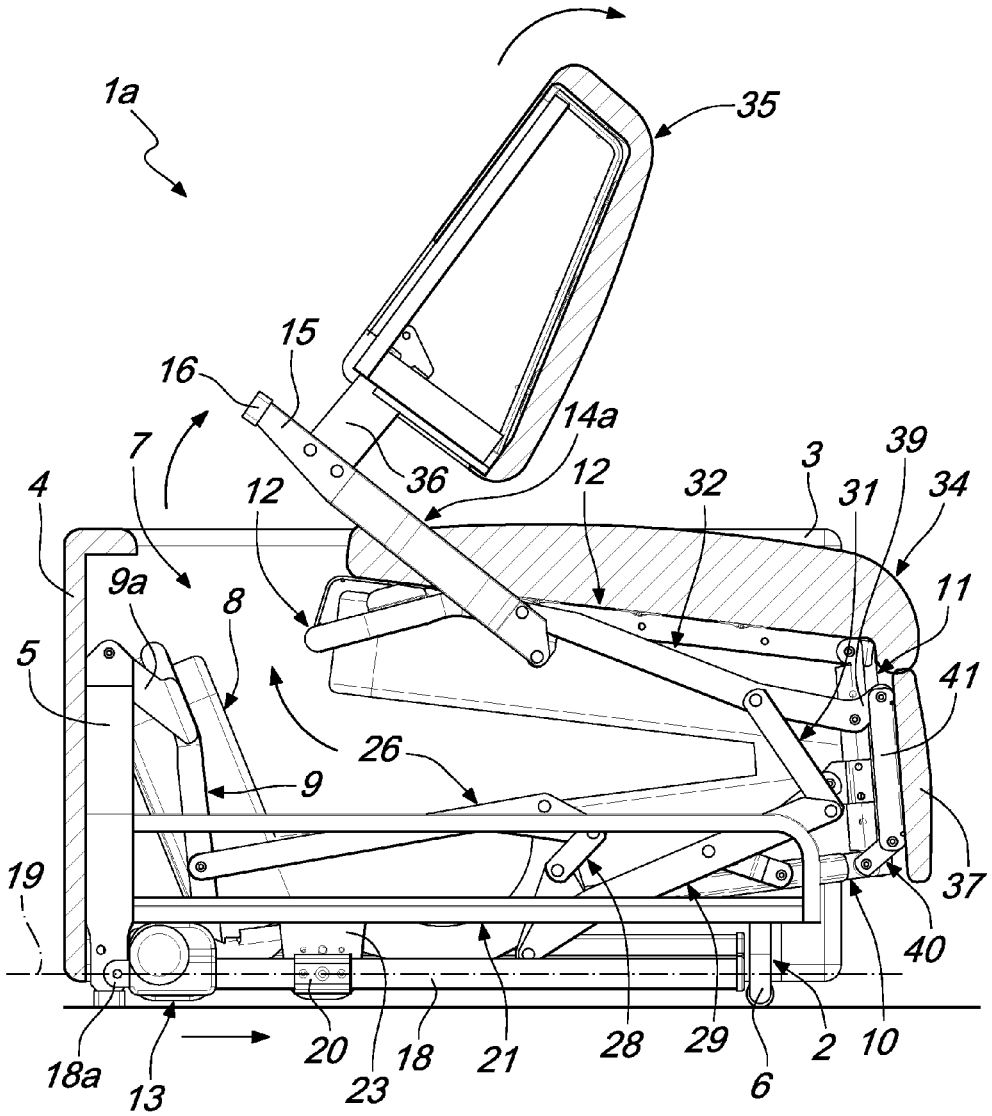
Figure 10:
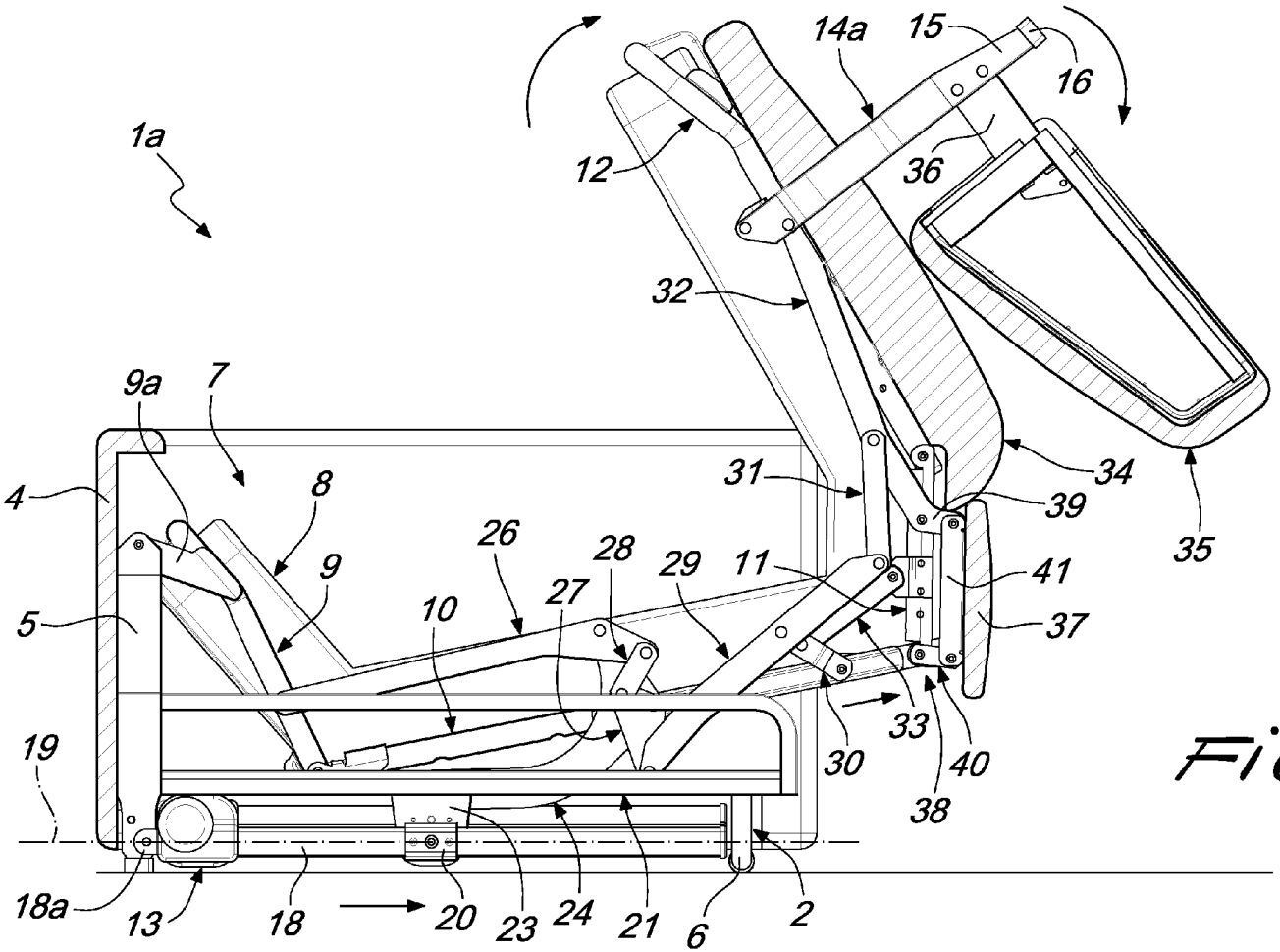
Figure 11:
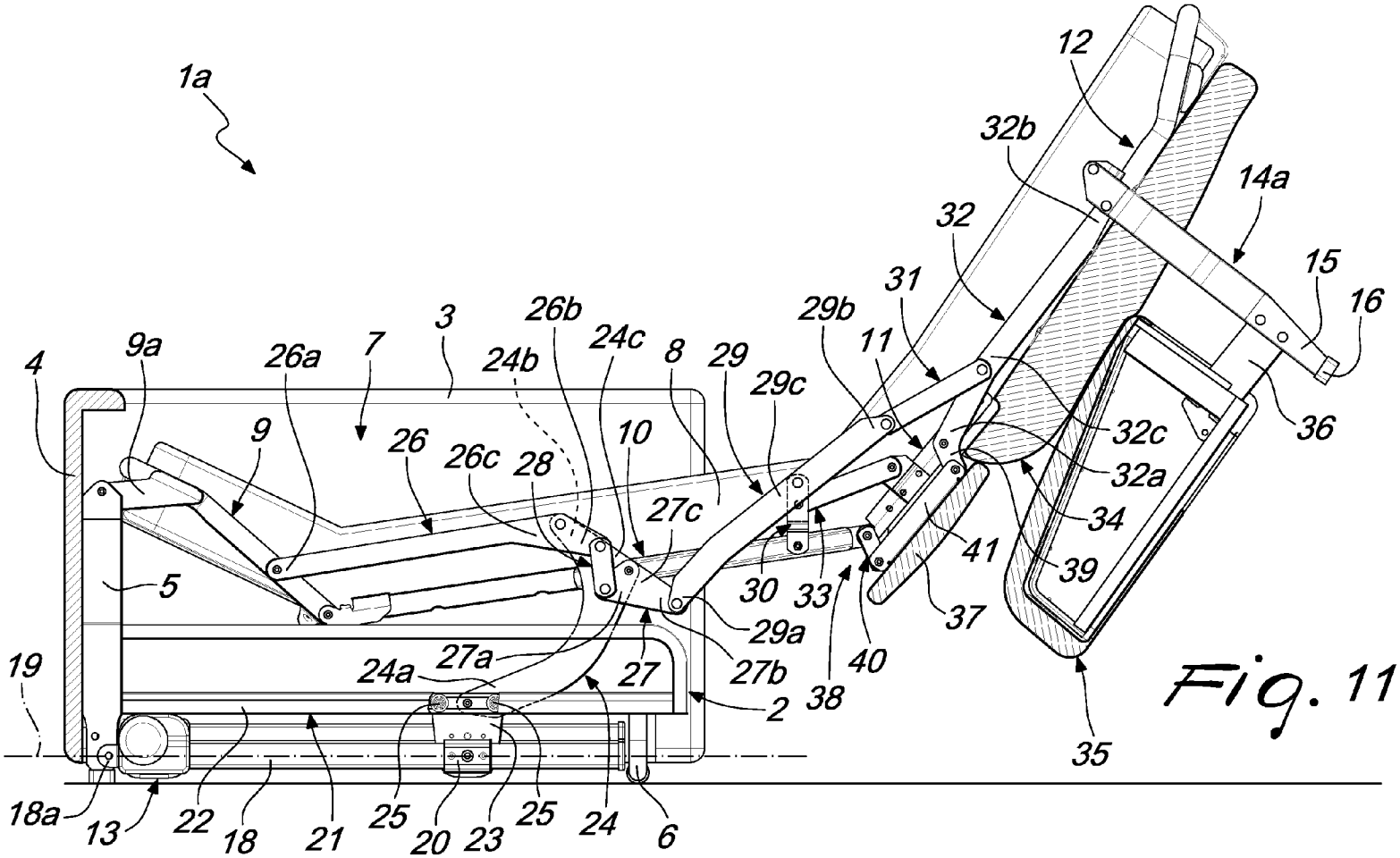
Figure 14:
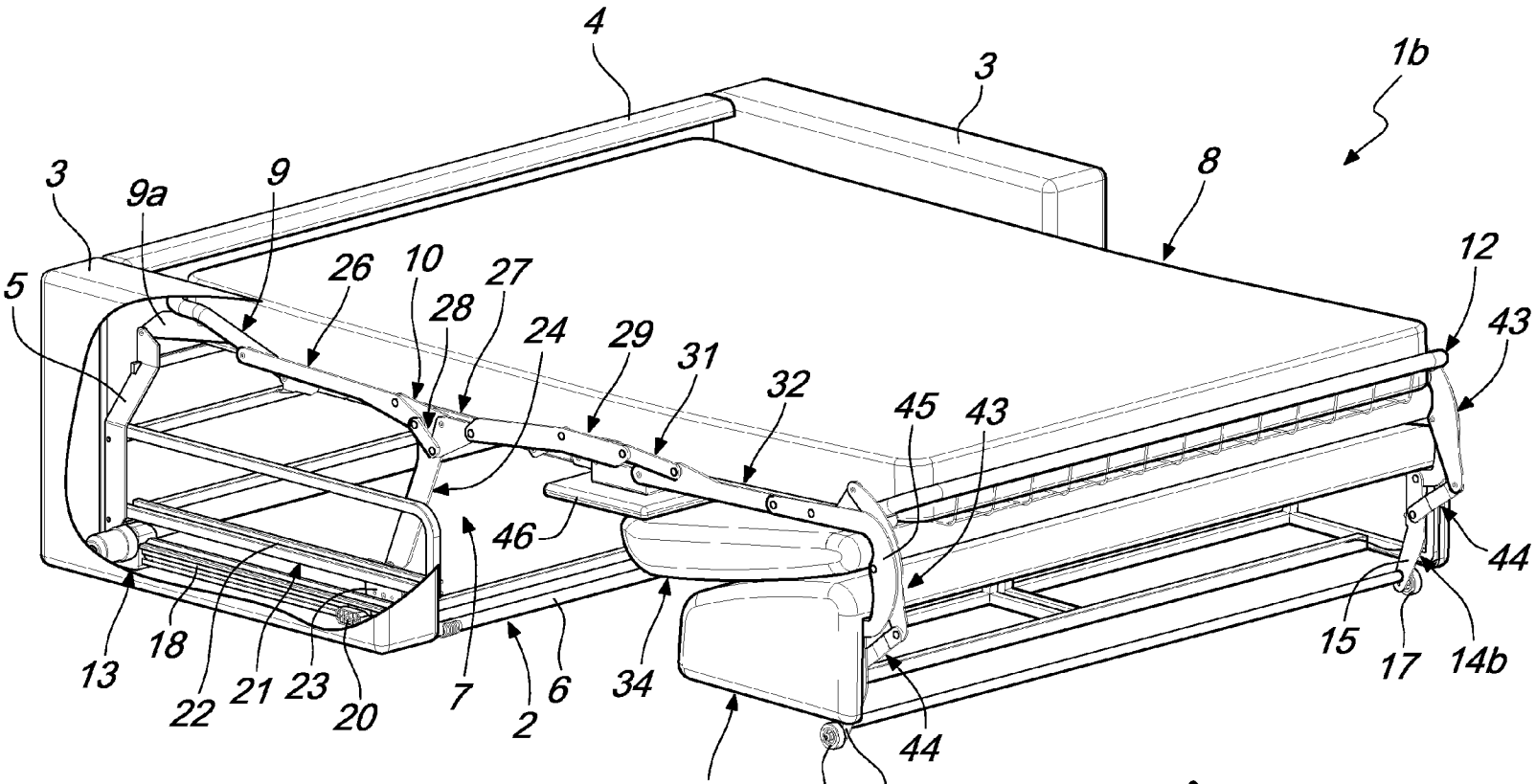
FIG. 14 is a partially cutout perspective view of a second embodiment of the sofa bed with facilitated opening, particularly with automatic actuation, according to the invention, in its open configuration.
Figure 15:
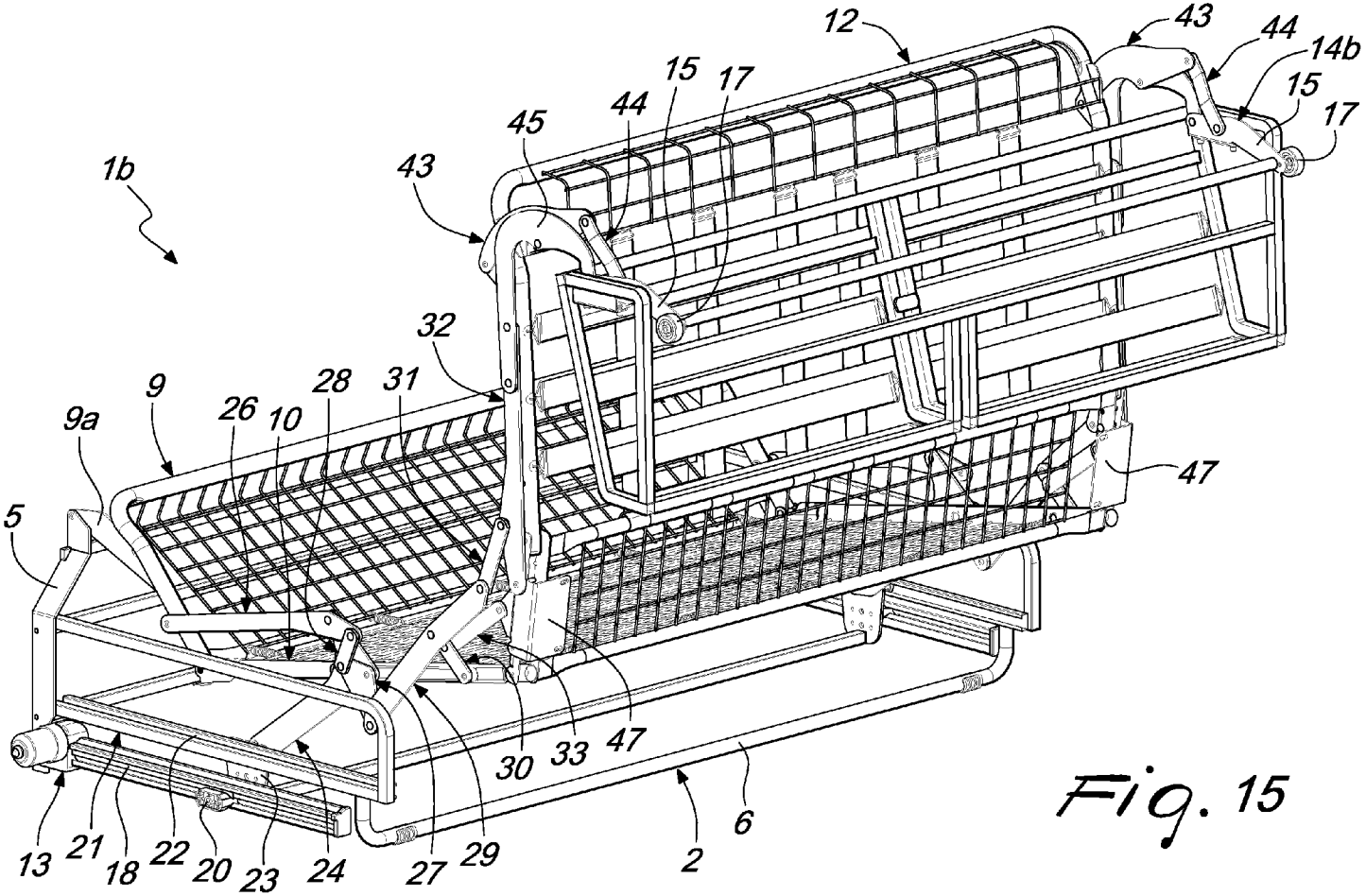
FIG. 15 is a perspective view of the mechanism of the sofa bed shown in FIG. 14 in a position which is intermediate between the closed and open configurations of the sofa bed.

This difference between the two embodiments is clearly visible in FIGS. 3 and 14.

In conclusion, the opening movement is not completed when the supporting legs 15 rest on the floor, but when the movable frames 9, 10, 11 and 12 are aligned perfectly.

Proceeding in reverse, instead, the transition from the open configuration to the closed configuration is obtained.

In practice it has been found that the sofa bed with facilitated opening, particularly with automatic actuation, according to the invention, being provided with a mechanism that is kinematically very different from the ones currently on the market, allows solving and overcoming, respectively, the drawbacks and the limitations of the background art, allowing the use of a single actuator arranged in the fixed structure of the sofa in order to be able to pass from one configuration to the other.

This is made possible by the fact that this mechanism, which has one single degree of freedom, cannot be opened and closed manually in the classical manner but can be opened and closed easily simply by operating the levers inside the fixed framework.

Another advantage of the sofa bed according to the present invention resides in that it has a very safe mechanism because by having one single degree of freedom it has a movement that is always the same and predictable.

Remaining again in the field of safety, a further advantage of the sofa bed according to the present invention resides in that it has a mechanism that is capable of opening and closing, remaining always very low from the floor, minimizing the height of the suspended masses during movement, thanks to the front covering panel, which translates together with the movable frames.

Another advantage of the sofa bed according to the present invention resides in that it defines, in its bed configuration, an extremely stable structure.

Figure 12:
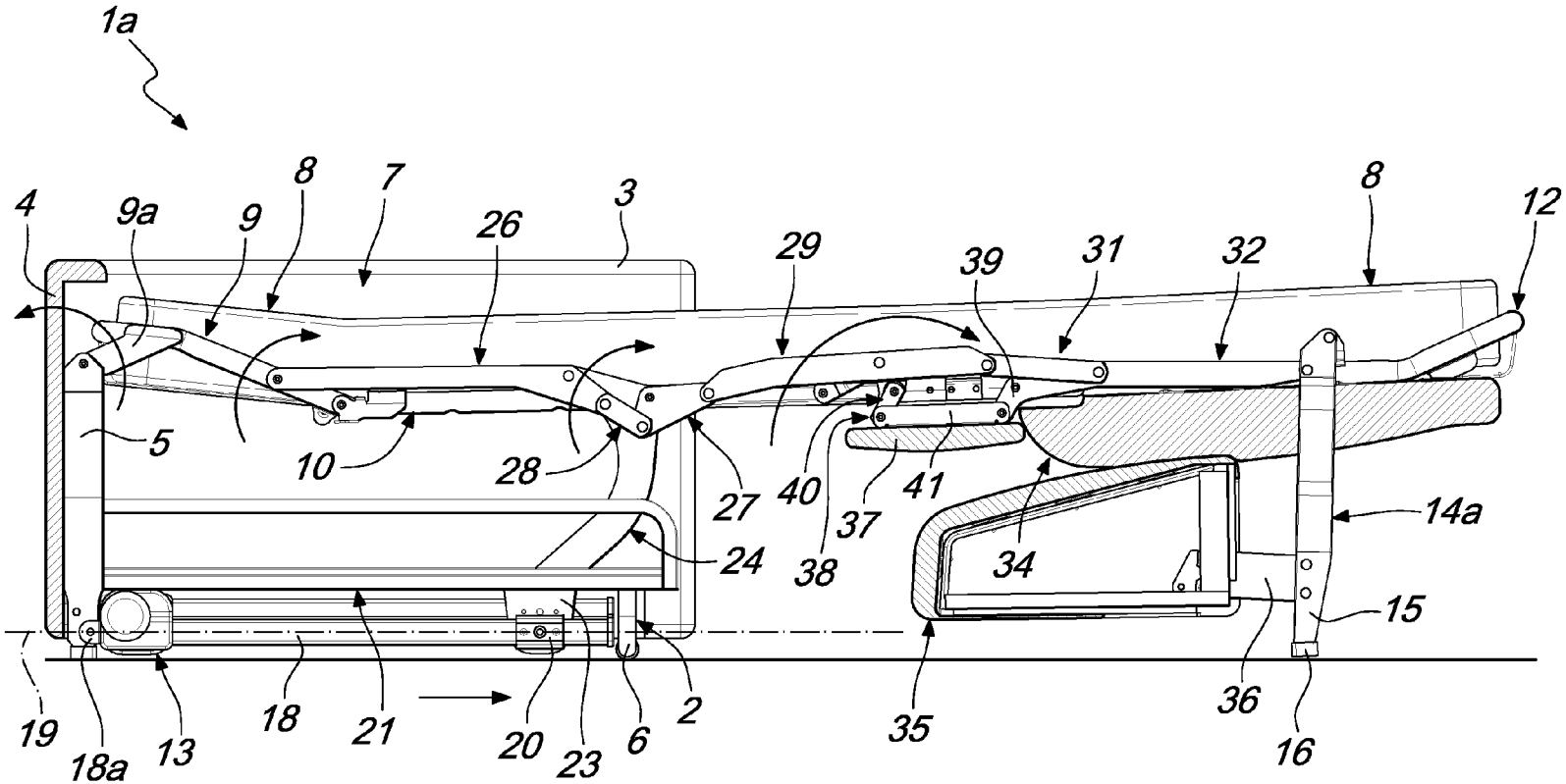
Figure 13:
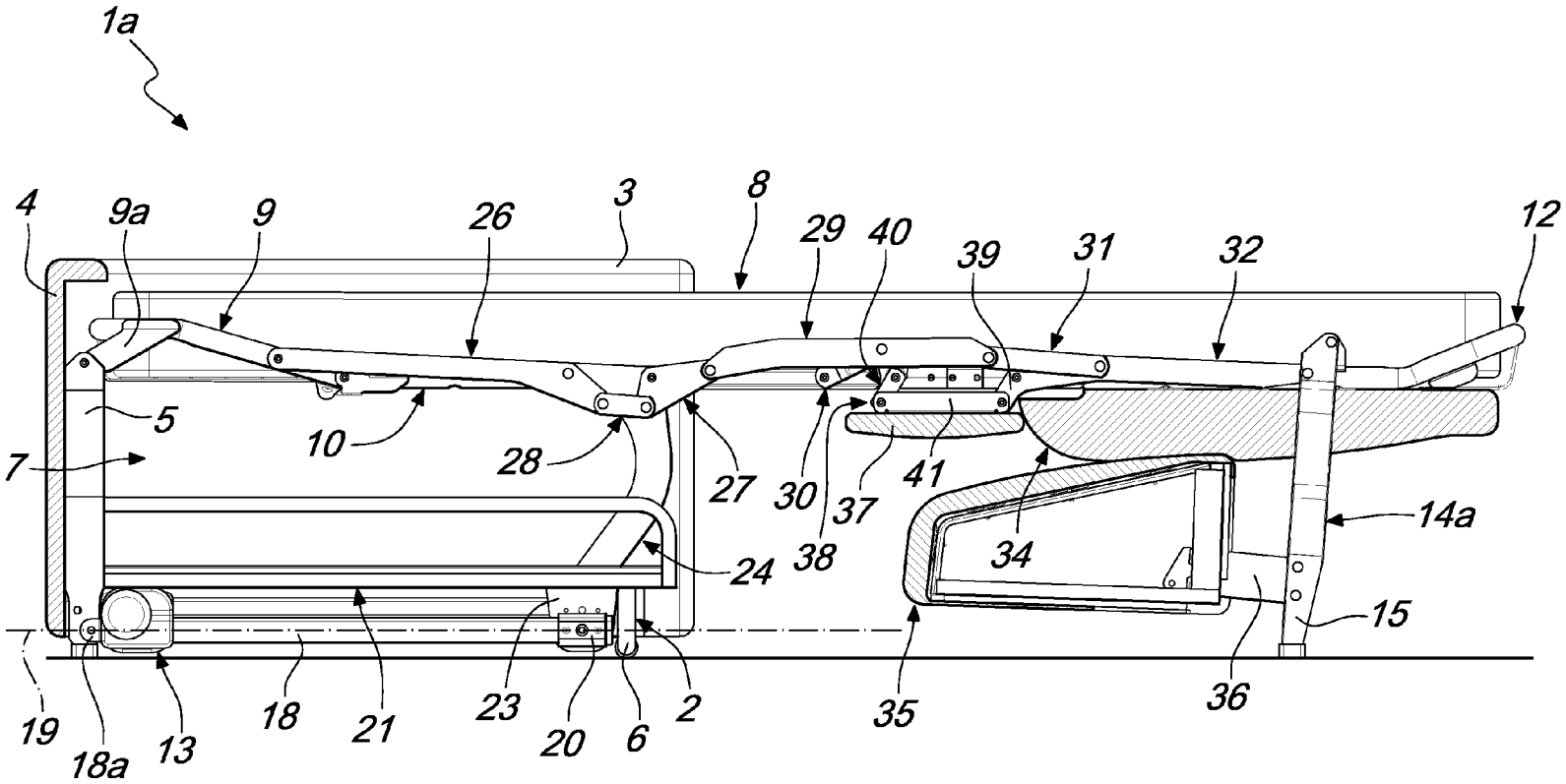

More precisely, this advantage is due to the fact that, as shown in FIG. 12, the supporting legs touch the floor before the alignment of the movable frames.

The stroke performed by the linear actuator, from the moment when the supporting legs rest on the floor until the movable frames are fully aligned, allows the first lever to assume an almost vertical position so as to prevent the spontaneous closure of the mechanism when the resting surface of the bed is loaded.

In this situation, an almost vertical force is discharged onto the horizontal guide of the slider of the linear actuator, making the backward movement of said slider practically impossible.

In any case, it is advisable to consider that linear actuators have a certain reduction ratio that hinders the movement of the slider when they are not powered. The solution according to the invention, however, makes it possible to avoid excessive stresses that might cause spontaneous backward movements of the slider or in any case cause damage to the linear actuator.

In this position, moreover, the alignment of three pivotal movements is achieved: the one between the first movable frame and the second lever, the one between the second lever and the first lever and the one between the first lever and the second movable frame.

This alignment contributes to the stability of the bed because it inhibits relative rotations of the first movable frame with respect to the second movable frame even if the user loads the pivotal movement between the two frames.

A further advantage of the sofa bed according to the present invention consists in that it requires from the linear actuator a reduced force in holding the mechanism in the last opening step and especially in lifting the mechanism in the first closing step. At these times, in fact, a sizable part of the mechanism is cantilevered out of the fixed framework. Moreover, in these steps the pivoting points of the mechanism are nearly all close to the resting surface of the mattress and there are many alignments which, as already mentioned, inhibit the spontaneous closure of the mechanism.

The partial folding of the structure, while the supporting legs are still resting on the floor, allows the interruption of these alignments, exactly in the way that the user would do it in the case of manual opening and closing mechanisms.

In fact, the resting reaction that operates on the supporting legs simulates exactly the lifting force applied by the user to the end of the bed in the case of manual mechanisms.

During the step in which the supporting legs rest on the floor, slight scrapings can occur in the point of contact, and therefore advantageously there is a resting wheel, as described in the second embodiment.

This solution, however, can be used also in the first embodiment, although in view of the extent of the movements it can be omitted.

When, at the end of this step, the lever arms become more favorable and the alignments are interrupted, the supporting legs leave the floor and the combined rotation and translation of the movable frames starts.

In this step, in any case, the linear actuator is assisted by the weight of the structure itself.

In fact, as mentioned, the second movable frame performs a movement of substantial downward translation during the closing movement, because it does not have to move beyond the front covering panel, thanks to the fact that said panel, too, translates together with the third frame.

In the mechanisms known so far, in fact, the second movable frame must move beyond the front covering panel, anchored rigidly to the fixed framework. This entails the fact that the trajectory followed by the second frame, during opening, is composed of three steps: the first step, substantially of rotation, until the end of the second frame does not move beyond the height of the front covering panel; the second step, of substantial translation, so that the cantilevered part of the second frame, too, moves beyond the height of the front covering panel; and finally a third step of rotation, opposite to the first one, for realigning said second frame.

During the closing movement, therefore, the rotation of the second movable frame would lift the third and fourth movable frames, the supporting legs, the back, the cushions of the seat and the mattress, and this effort would bear fully on the actuator.

In the case of the mechanism being considered, instead, there is no rotation of the second movable frame, but a substantial downward translation aided by the force of gravity, which cooperates in the work of partial lifting of the elements listed above.

In practice negative work applied by the force of gravity to the elements of the kinematic chain from the pivoting point between the second movable frame and the third movable frame onward is contrasted by positive work applied by the force of gravity to the elements that are arranged before said pivoting point.

Again in the perspective of reducing the force required from the actuator, the system with linear movement of the pivoting allows the use of actuators with a long stroke, so that for an equal work to be performed they require lower forces.

In fact, thanks to these solutions, the force required from the linear actuator, during opening and closing, is considerably low and allows increasing the general reliability of the system.

A further advantage of the sofa bed according to the present invention resides in that the linear actuator never moves from its initial position but always remains stationary inside the fixed framework, allowing therefore a simple and reliable wiring besides quick and safe assembly.

Moreover, its position is concealed by the lateral armrests, leading to considerable benefits in terms of aesthetics as well as quietness, cleanness and safety of operation.

Another advantage of the sofa bed according to the present invention, linked to the fact of having a front covering panel that moves forward with the movable frames instead of being fixed rigidly to the fixed framework, resides in that it increases further the level of safety of the sofa bed.

In fact, this is a great advantage in terms of safety, because it allows the exit of the movable frames from the fixed framework without having to move beyond the obstacle represented by the front covering panel, making it possible to follow a lower trajectory, keeping the suspended masses at a relatively low height from the floor.

In addition, in case of breakage of the mechanism, in fact, the fall of these suspended elements is far less dangerous.

Moreover, this lower height from the floor allows the person who operates the mechanism to check what is happening on the other side, preventing, for example, a child or pet from getting under the mechanism during movement.

One should not underestimate also that this mechanism allows the use of covering panels of even substantial heights, with obvious benefits in terms of design flexibility.

The sofa bed with facilitated opening, particularly with automatic actuation, according to the present invention, thus conceived is susceptible of numerous modifications and variations, all of which are within the scope of the appended claims.

All the details may further be replaced with other technically equivalent elements.

In practice, the materials used, as long as they are compatible with the specific use, as well as the contingent shapes and dimensions, may be any according to requirements and to the state of the art.

The disclosures in Italian Patent Application No. MI2012A000001 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A sofa bed with facilitated opening, particularly with automatic actuation, comprising:

a fixed framework which defines a compartment for accommodating a mattress that can fold into at least four parts and is supported by at least four movable frames, one for each one of said parts of said mattress, a first of said at least four movable frames being associated with said fixed framework, said at least four movable frames being mutually articulated sequentially with respect to each other to define a kinematic chain, with one degree of freedom, which can move between a closed configuration, in which said at least four movable frames are substantially mutually opposite in pairs in order to define a cage-like structure that encloses said mattress folded into at least four parts, and an open configuration, in which said at least four movable frames are substantially mutually aligned to define a resting surface on which said unfolded mattress lies; and motor means being also provided which are associated with said fixed framework and are functionally connected to said at least four movable frames for their movement between said open configuration and said closed configuration, wherein said motor means comprises at least one linear actuator which operates along a straight line of action which is substantially parallel to the unfolding direction of said at least four movable frames, said at least one linear actuator pivoted to said fixed frame and functionally associated with said at least four movable frames by a plurality of levers which are interconnected and are associated with said at least four movable frames, wherein said fixed framework has, in a side view, a substantially L-shaped configuration which defines a lower footing on which said at least one linear actuator and a vertical upright are fixed, said vertical upright arranged at a rear portion of said sofa bed, to which the first movable frame is pivoted at a free end thereof, said at least one linear actuator moving a slider associated with a first lever of said plurality of levers and movable along a fixed straight guide defined by said lower footing; and wherein said straight guide is defined by a horizontal track in which an actuation bracket is accommodated slidingly and is integral in translational motion with said slider and pivoted to one end of said first lever.

2. The sofa bed of claim 1, further comprising at least one fifth movable frame associated with a last one of said at least four movable frames and defines supporting legs arranged in said open configuration on the side opposite to said fixed framework to support said resting surface.

3. The sofa bed of claim 1, wherein said first lever is pivoted at an other end thereof to an intermediate portion of a second lever of said plurality of levers, said first lever being pivoted at an intermediate portion to an intermediate portion of a second one of said at least four movable frames and said second lever being pivoted, with one end of said second lever, to an intermediate portion of said first movable frame.

4. The sofa bed of claim 3, further comprising a transmission lever substantially L-shaped and pivoted, at the vertex of said L-shape, to said first lever substantially at the pivoting point between said first lever and said second movable frame, wherein ends of said transmission lever are pivoted, respectively, to a first linkage, which in turn is pivoted to an end of said second lever, and to an end of a third lever of said plurality of levers associated with a third movable frame and with a fourth movable frame of said at least four movable frames.

5. The sofa bed of claim 4, further comprising a front covering panel associated with said third movable frame and can move with said third movable frame during transition from said closed configuration to said open configuration.

6. The sofa bed of claim 4, wherein said third lever is pivoted at an intermediate portion thereof to a second linkage, which in turn is pivoted to said second movable frame proximate to the pivoting point between said second movable frame and said third movable frame, the other end of said third lever pivoted to a third linkage, which in turn is pivoted to an intermediate portion of a fourth lever of said plurality of levers associated with said third movable frame and with a fifth movable frame, said second linkage pivoted, at an intermediate portion thereof, to a fourth linkage, which in turn is pivoted to an intermediate portion of said third movable frame.

7. The sofa bed of claim 6, wherein said fourth lever is pivoted at its ends respectively to said third movable frame between the pivoting point to said fourth linkage and the pivoting point to said fourth movable frame and to said fifth movable frame.

8. The sofa bed of claim 4, further comprising cushions of a seat associated with said fourth movable frame on the side opposite to said mattress.

9. The sofa bed of claim 2, further comprising one of a resting foot and a resting wheel associated with each of one of said supporting legs.

10. The sofa bed of claim 1, further comprising a rear covering panel associated with said vertical upright on the side opposite to said mattress.

11. The sofa bed of claim 2, further comprising a back integrally connected to said fifth movable frame by a supporting bracket integral with and substantially perpendicular to said fifth movable frame, said fifth movable frame pivoted to a fourth movable frame of said plurality of movable frames.

12. The sofa bed of claim 11, further comprising a front covering panel associated with a third movable frame of said plurality of movable frames on the side opposite to said mattress by an articulated quadrilateral structure provided by said third movable frame, by a protruding tab of a fourth lever of said plurality of levers which is defined proximate to said third movable frame and is pivoted to a support, which supports rigidly said front covering panel, and by a fifth linkage, which is pivoted with its ends respectively to said support and to said third movable frame substantially at its pivoting point to a second movable frame of said plurality of frames.

13. The sofa bed according to claim 2, further comprising a back integral with said fifth movable frame, an end of a fourth lever of said plurality of levers being pivoted to said fifth movable frame which is substantially C-shaped in such a way as to partially surround cushions of a seat, a fifth lever of said plurality of levers also provided which is pivoted at its end to a fourth movable frame of said plurality of movable frames and to a sixth linkage, which in turn is pivoted to an intermediate portion of said fifth movable frame, the intermediate portion of said fifth lever being pivoted to the central position of a substantially C-shaped end of said fourth lever for rotation of said back in the transition from said closed configuration to said open configuration and vice versa.

14. The sofa bed of claim 13, further comprising a front covering panel, which is anchored rigidly, by a support, to a third movable frame of said plurality of movable frames on the side opposite to said mattress.

15. The sofa bed of claim 13, wherein said back is provided by a framework which defines internally a compartment for storing pillows or blankets therein.

* * * * *